US010529286B2

(12) United States Patent
Koyama

(10) Patent No.: US 10,529,286 B2
(45) Date of Patent: Jan. 7, 2020

(54) DISPLAY CORRECTION CIRCUIT, DISPLAY CORRECTION SYSTEM, AND DISPLAY DEVICE

(71) Applicant: Semiconductor Energy Laboratory Co., Ltd., Kanagawa-ken (JP)

(72) Inventor: Jun Koyama, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 136 days.

(21) Appl. No.: 14/707,414

(22) Filed: May 8, 2015

(65) Prior Publication Data

US 2015/0325172 A1 Nov. 12, 2015

(30) Foreign Application Priority Data

May 9, 2014 (JP) ..... 2014-097986

(51) Int. Cl.
*G09G 3/3291* (2016.01)
*G09G 3/3233* (2016.01)

(52) U.S. Cl.
CPC ..... *G09G 3/3291* (2013.01); *G09G 3/3233* (2013.01); *G09G 2300/0842* (2013.01); *G09G 2300/0866* (2013.01); *G09G 2310/0256* (2013.01); *G09G 2320/02* (2013.01); *G09G 2320/043* (2013.01)

(58) Field of Classification Search
None
See application file for complete search history.

(56) References Cited

U.S. PATENT DOCUMENTS 5,113,077 A 5/1992 Shimizu et al.
5,731,856 A 3/1998 Kim et al.
5,744,864 A 4/1998 Cillessen et al.
6,294,274 B1 9/2001 Kawazoe et al.
6,563,174 B2 5/2003 Kawasaki et al.
(Continued)

FOREIGN PATENT DOCUMENTS

EP 1737044 A 12/2006
EP 2226847 A 9/2010
(Continued)

OTHER PUBLICATIONS

Asakuma.N et al., "Crystallization and Reduction of Sol-Gel-Derived Zinc Oxide Films by Irradiation With Ultraviolet Lamp", Journal of Sol-Gel Science and Technology, 2003, vol. 26, pp. 181-184.

(Continued)

*Primary Examiner* — Amare Mengistu
*Assistant Examiner* — Sarvesh J Nadkarni
(74) *Attorney, Agent, or Firm* — Husch Blackwell LLP

(57) ABSTRACT

To improve display quality of a pixel of an organic EL panel. Display correction is performed in the pixel with a small number of transistors in the pixel of the organic EL panel. A capacitor and an oxide semiconductor transistor are formed in a display driver IC. A minute current flowing in the pixel is measured from the amount of change in capacitor voltage to correct display. Because the off-state current of an oxide semiconductor is extremely small even at high temperatures, current can be accurately measured and display images can be accurately corrected.

10 Claims, 9 Drawing Sheets

(56) References Cited

U.S. PATENT DOCUMENTS 6,727,522 B1 4/2004 Kawasaki et al.
7,049,190 B2 5/2006 Takeda et al.
7,061,014 B2 6/2006 Hosono et al.
7,064,346 B2 6/2006 Kawasaki et al.
7,088,052 B2 8/2006 Kimura
7,105,868 B2 9/2006 Nause et al.
7,211,825 B2 5/2007 Shih et al.
7,282,782 B2 10/2007 Hoffman et al.
7,297,977 B2 11/2007 Hoffman et al.
7,323,356 B2 1/2008 Hosono et al.
7,385,224 B2 6/2008 Ishii et al.
7,402,506 B2 7/2008 Levy et al.
7,411,209 B2 8/2008 Endo et al.
7,453,065 B2 11/2008 Saito et al.
7,453,087 B2 11/2008 Iwasaki
7,462,862 B2 12/2008 Hoffman et al.
7,468,304 B2 12/2008 Kaji et al.
7,501,293 B2 3/2009 Ito et al.
7,674,650 B2 3/2010 Akimoto et al.
7,732,819 B2 6/2010 Akimoto et al.
8,519,992 B2 8/2013 Teranishi et al.
8,599,186 B2 12/2013 Ogura
8,698,066 B2 4/2014 Sugita
8,947,328 B2 2/2015 Kimura
2001/0046027 A1 11/2001 Tai et al.
2002/0056838 A1 5/2002 Ogawa
2002/0132454 A1 9/2002 Ohtsu et al.
2003/0189401 A1 10/2003 Kido et al.
2003/0218222 A1 11/2003 Wager, III et al.
2004/0038446 A1 2/2004 Takeda et al.
2004/0127038 A1 7/2004 Carcia et al.
2005/0017302 A1 1/2005 Hoffman
2005/0199959 A1 9/2005 Chiang et al.
2006/0035452 A1 2/2006 Carcia et al.
2006/0043377 A1* 3/2006 Hoffman ..... H01L 29/7869 257/72
2006/0091793 A1 5/2006 Baude et al.
2006/0108529 A1 5/2006 Saito et al.
2006/0108636 A1 5/2006 Sano et al.
2006/0110867 A1 5/2006 Yabuta et al.
2006/0113536 A1 6/2006 Kumomi et al.
2006/0113539 A1 6/2006 Sano et al.
2006/0113549 A1 6/2006 Den et al.
2006/0113565 A1 6/2006 Abe et al.
2006/0169973 A1 8/2006 Isa et al.
2006/0170111 A1 8/2006 Isa et al.
2006/0197092 A1 9/2006 Hoffman et al.
2006/0208977 A1 9/2006 Kimura
2006/0228974 A1 10/2006 Thelss et al.
2006/0231882 A1 10/2006 Kim et al.
2006/0238135 A1 10/2006 Kimura
2006/0244107 A1 11/2006 Sugihara et al.
2006/0284171 A1 12/2006 Levy et al.
2006/0284172 A1 12/2006 Ishii
2006/0292777 A1 12/2006 Dunbar
2007/0024187 A1 2/2007 Shin et al.
2007/0046191 A1 3/2007 Saito
2007/0052025 A1 3/2007 Yabuta
2007/0054507 A1 3/2007 Kaji et al.
2007/0090365 A1 4/2007 Hayashi et al.
2007/0108446 A1 5/2007 Akimoto
2007/0152217 A1 7/2007 Lai et al.
2007/0172591 A1 7/2007 Seo et al.
2007/0187678 A1 8/2007 Hirao et al.
2007/0187760 A1 8/2007 Furuta et al.
2007/0194379 A1 8/2007 Hosono et al.
2007/0252928 A1 11/2007 Ito et al.
2007/0272922 A1 11/2007 Kim et al.
2007/0287296 A1 12/2007 Chang
2008/0006877 A1 1/2008 Mardilovich et al.
2008/0038882 A1 2/2008 Takechi et al.
2008/0038929 A1 2/2008 Chang
2008/0050595 A1 2/2008 Nakagawara et al.
2008/0073653 A1 3/2008 Iwasaki
2008/0083950 A1 4/2008 Pan et al.
2008/0106191 A1 5/2008 Kawase
2008/0128689 A1 6/2008 Lee et al.
2008/0129195 A1 6/2008 Ishizaki et al.
2008/0166834 A1 7/2008 Kim et al.
2008/0180365 A1 7/2008 Ozaki
2008/0182358 A1 7/2008 Cowdery-Corvan et al.
2008/0224133 A1 9/2008 Park et al.
2008/0254569 A1 10/2008 Hoffman et al.
2008/0258139 A1 10/2008 Ito et al.
2008/0258140 A1 10/2008 Lee et al.
2008/0258141 A1 10/2008 Park et al.
2008/0258143 A1 10/2008 Kim et al.
2008/0296568 A1 12/2008 Ryu et al.
2009/0068773 A1 3/2009 Lai et al.
2009/0073325 A1 3/2009 Kuwabara et al.
2009/0114910 A1 5/2009 Chang
2009/1013439 5/2009 Sakakuram et al.
2009/0152506 A1 6/2009 Umeda et al.
2009/0152541 A1 6/2009 Maekawa et al.
2009/0248344 A1* 10/2009 Hirabayashi ..... G01J 1/0228 702/85
2009/0278122 A1 11/2009 Hosono et al.
2009/0280600 A1 11/2009 Hosono et al.
2010/0065844 A1 3/2010 Tokunaga
2010/0092800 A1 4/2010 Itagaki et al.
2010/0109002 A1 5/2010 Itagaki et al.
2010/0321367 A1* 12/2010 Shona ..... G09G 3/3233 345/211
2012/0287177 A1 11/2012 Koyama et al.
2013/0021316 A1 1/2013 Inoue et al.
2013/0050292 A1 2/2013 Mizukoshi
2013/0162617 A1 6/2013 Yoon et al.
2015/0187818 A1 7/2015 Miyake et al.

FOREIGN PATENT DOCUMENTS

JP 60-198861 A 10/1985
JP 63-210022 A 8/1988
JP 63-210023 A 8/1988
JP 63-210024 A 8/1988
JP 63-215519 A 9/1988
JP 63-239117 A 10/1988
JP 63-265818 A 11/1988
JP 03-122588 A 5/1991
JP 05-251705 A 9/1993
JP 08-264794 A 10/1996
JP 11-505377 5/1999
JP 2000-044236 A 2/2000
JP 2000-150900 A 5/2000
JP 2002-076356 A 3/2002
JP 2002-289859 A 10/2002
JP 2003-086000 A 3/2003
JP 2003-086808 A 3/2003
JP 2004-103957 A 4/2004
JP 2004-273614 A 9/2004
JP 2004-273732 A 9/2004
JP 2007-334313 A 12/2007
JP 2011-154348 A 8/2011
JP 2012-160772 A 8/2012
JP 2013-137498 A 7/2013
JP 2015-129926 A 7/2015
WO WO-2004/114391 12/2004
WO WO 2007/037269 A1 4/2007

OTHER PUBLICATIONS

Asaoka.Y et al., "29.1:Polarizer-Free Reflective LCD Combined With Ultra Low-Power Driving Technology", SID Digest '09 : SID International Symposium Digest of Technical Papers, May 31, 2009, pp. 395-398.

Chern.H et al., "An Analytical Model for the Above-Threshold Characteristics of Polysilicon Thin-Film Transistors", IEEE Transactions on Electron Devices, Jul. 1, 1995, vol. 42, No. 7, pp. 1240-1246.

Cho.D et al., "21.2:Al and Sn-Doped Zinc Indium Oxide Thin Film Transistors for AMOLED Back-Plane", SID Digest '09 : SID

(56) References Cited

OTHER PUBLICATIONS

International Symposium Digest of Technical Papers, May 31, 2009, pp. 280-283.
Clark.S et al., "First Principles Methods Using CASTEP", Zeitschrift fur Kristallographie, 2005, vol. 220, pp. 567-570.
Coates.D et al., "Optical Studies of the Amorphous Liquid-Cholesteric Liquid Crystal Transition:The "Blue Phase"", Physics Letters, Sep. 10, 1973, vol. 45A, No. 2, pp. 115-116.
Costello.M et al., "Electron Microscopy of a Cholesteric Liquid Crystal and Its Blue Phase", Phys. Rev. A (Physical Review. A), May 1, 1984, vol. 29, No. 5, pp. 2957-2959.
Dembo.H et al., "RFCPUS on Glass and Plastic Substrates Fabricated by TFT Transfer Technology", IEDM 05: Technical Digest of International Electron Devices Meeting, Dec. 5, 2005, pp. 1067-1069.
Fortunato.E et al., "Wide-Bandgap High-Mobility ZnO Thin-Film Transistors Produced at Room Temperature", Appl. Phys. Lett. (Applied Physics Letters) , Sep. 27, 2004, vol. 85, No. 13, pp. 2541-2543.
Fung.T et al., "2-D Numerical Simulation of High Performance Amorphous In-Ga-Zn-O TFTs for Flat Panel Displays", AM-FPD '08 Digest of Technical Papers, Jul. 2, 2008, pp. 251-252, The Japan Society of Applied Physics.
Godo.H et al., "P-9:Numerical Analysis on Temperature Dependence of Characteristics of Amorphous In-Ga-Zn-Oxide TFT", SID Digest '09 : SID International Symposium Digest of Technical Papers, May 31, 2009, pp. 1110-1112.
Godo.H et al., "Temperature Dependence of Characteristics and Electronic Structure for Amorphous In-Ga-Zn-Oxide TFT", AM-FPD '09 Digest of Technical Papers, Jul. 1, 2009, pp. 41-44.
Hayashi.R et al., "42.1: Invited Paper: Improved Amorphous In-Ga-Zn-O TFTS", SID Digest '08 : SID International Symposium Digest of Technical Papers, May 20, 2008, vol. 39, pp. 621-624.
Hirao.T et al., "Novel Top-Gate Zinc Oxide Thin-Film Transistors (ZnO TFTS) for AMLCDS", J. Soc. Inf. Display (Journal of the Society for Information Display), 2007, vol. 15, No. 1, pp. 17-22.
Hosono.H et al., "Working hypothesis to explore novel wide band gap electrically conducting amorphous oxides and examples", J. Non-Cryst. Solids (Journal of Non-Crystalline Solids), 1996, vol. 198-200, pp. 165-169.
Hosono.H, "68.3:Invited Paper:Transparent Amorphous Oxide Semiconductors for High Performance TFT", SID Digest '07 : SID International Symposium Digest of Technical Papers, 2007, vol. 38, pp. 1830-1833.
Hsieh.H et al., "P-29:Modeling of Amorphous Oxide Semiconductor Thin Film Transistors and Subgap Density of States", SID DIGEST '08 : SID International Symposium Digest of Technical Papers, May 20, 2008, vol. 39, pp. 1277-1280.
Ikeda.T et al., "Full-Functional System Liquid Crystal Display Using CG-Silicon Technology", SID Digest '04 : SID International Symposium Digest of Technical Papers, 2004, vol. 35, pp. 860-863.
Janotti.A et al., "Native Point Defects in ZnO", Phys. Rev. B (Physical Review. B), Oct. 4, 2007, vol. 76, No. 16, pp. 165202-1-165202-22.
Janotti.A et al., "Oxygen Vacancies in ZnO", Appl. Phys. Lett. (Applied Physics Letters) , 2005, vol. 87, pp. 122102-1-122102-3.
Jeong.J et al., "3.1: Distinguished Paper: 12.1-Inch WXGA AMOLED Display Driven by Indium-Gallium-Zinc Oxide TFTs Array", SID Digest '08 : SID International Symposium Digest of Technical Papers, May 20, 2008, vol. 39, No. 1, pp. 1-4.
Jin.D et al., "65.2:Distinguished Paper:World-Largest (6.5") Flexible Full Color Top Emission AMOLED Display on Plastic Film and Its Bending Properties", SID Digest '09 : SID International Symposium Digest of Technical Papers, May 31, 2009, pp. 983-985.
Kanno.H et al., "White Stacked Electrophosphorecent Organic Light-Emitting Devices Employing MOO3 As a Charge-Generation Layer", Adv. Mater. (Advanced Materials), 2006, vol. 18, No. 3, pp. 339-342.
Kikuchi.H et al., "39.1:Invited Paper:Optically Isotropic Nano-Structured Liquid Crystal Composites for Display Applications", SID Digest '09 : SID International Symposium Digest of Technical Papers, May 31, 2009, pp. 578-581.
Kikuchi.H et al., "62.2:Invited Paper:Fast Electro-Optical Switching in Polymer-Stabilized Liquid Crystalline Blue Phases for Display Application", SID Digest '07 : SID International Symposium Digest of Technical Papers, 2007, vol. 38, pp. 1737-1740.
Kikuchi.H et al., "Polymer-Stabilized Liquid Crystal Blue Phases", Nature Materials, Sep. 2, 2002, vol. 1, pp. 64-68.
Kim.S et al., "High-Performance oxide thin film transistors passivated by various gas plasmas", 214th ECS Meeting, 2008, No. 2317, ECS.
Kimizuka.N et al., "Spinel, YbFe2O4, and Yb2Fe3O7 Types of Structures for Compounds in the In2O3 and Sc2O3-A2O3-Bo Systems [A; Fe, Ga, or Al; B: Mg, Mn, Fe, Ni, Cu,or Zn] at Temperatures Over 1000° C.", Journal of Solid State Chemistry, 1985, vol. 60, pp. 382-384.
Kimizuka.N et al., "Syntheses and Single-Crystal Data of Homologous Compounds, In2O3(ZnO)m (m=3, 4, and 5), InGaO3(ZnO)3, and Ga2O3(ZnO)m (m=7, 8, 9, and 16) in the In2O3-ZnGa2O4-ZnO System", Journal of Solid State Chemistry, Apr. 1, 1995, vol. 116, No. 1, pp. 170-178.
Kitzerow.H et al., "Observation of Blue Phases in Chiral Networks", Liquid Crystals, 1993, vol. 14, No. 3, pp. 911-916.
Kurokawa.Y et al., "UHF RFCPUS on Flexible and Glass Substrates for Secure RFID Systems", Journal of Solid-State Circuits , 2008, vol. 43, No. 1, pp. 292-299.
Lany.S et al., "Dopability, Intrinsic Conductivity, and Nonstoichiometry of Transparent Conducting Oxides", Phys. Rev. Lett. (Physical Review Letters), Jan. 26, 2007, vol. 98, pp. 045501-1-045501-4.
Lee.H et al., "Current Status of, Challenges to, and Perspective View of AM-OLED ", IDW '06 : Proceedings of the 13th International Display Workshops, Dec. 7, 2006, pp. 663-666.
Lee.J et al., "World's Largest (15-Inch) XGA AMLCD Panel Using IGZO Oxide TFT", SID Digest '08 : SID International Symposium Digest of Technical Papers, May 20, 2008, vol. 39, pp. 625-628.
Lee.M et al., "15.4:Excellent Performance of Indium-Oxide-Based Thin-Film Transistors by DC Sputtering", SID Digest '09 : SID International Symposium Digest of Technical Papers, May 31, 2009, pp. 191-193.
Li.C et al., "Modulated Structures of Homologous Compounds InMO3(ZnO)m (M=In,Ga; m=Integer) Described by Four-Dimensional Superspace Group", Journal of Solid State Chemistry, 1998, vol. 139, pp. 347-355.
Masuda.S et al., "Transparent thin film transistors using ZnO as an active channel layer and their electrical properties", J. Appl. Phys. (Journal of Applied Physics) , Feb. 1, 2003, vol. 93, No. 3, pp. 1624-1630.
Meiboom.S et al., "Theory of the Blue Phase of Cholesteric Liquid Crystals", Phys. Rev. Lett. (Physical Review Letters), May 4, 1981, vol. 46, No. 18, pp. 1216-1219.
Miyasaka.M, "SUFTLA Flexible Microelectronics on Their Way to Business", SID Digest '07 : SID International Symposium Digest of Technical Papers, 2007, vol. 38, pp. 1673-1676.
Mo.Y et al., "Amorphous Oxide TFT Backplanes for Large Size AMOLED Displays", IDW '08 : Proceedings of the 6th International Display Workshops, Dec. 3, 2008, pp. 581-584.
Nakamura.M et al., "The phase relations in the In2O3-Ga2ZnO4-ZnO system at 1350° C.", Journal of Solid State Chemistry, Aug. 1, 1991, vol. 93, No. 2, pp. 298-315.
Nakamura.M, "Synthesis of Homologous Compound with New Long-Period Structure", NIRIM Newsletter, Mar. 1, 1995, vol. 150, pp. 1-4.
Nomura.K et al., "Amorphous Oxide Semiconductors for High-Performance Flexible Thin-Film Transistors", JPN. J. Appl. Phys. (Japanese Journal of Applied Physics) , 2006, vol. 45, No. 5B, pp. 4303-4308.
Nomura.K et al., "Carrier transport in transparent oxide semiconductor with intrinsic structural randomness probed using single-crystalline InGaO3(ZnO)5 films", Appl. Phys. Lett. (Applied Physics Letters) , Sep. 13, 2004, vol. 85, No. 11, pp. 1993-1995.
Nomura.K et al., "Room-Temperature Fabrication of Transparent Flexible Thin-Film Transistors Using Amorphous Oxide Semiconductors", Nature, Nov. 25, 2004, vol. 432, pp. 488-492.

(56) References Cited

OTHER PUBLICATIONS

Nomura.K et al., "Thin-Film Transistor Fabricated in Single-Crystalline Transparent Oxide Semiconductor", Science, May 23, 2003, vol. 300, No. 5623, pp. 1269-1272.
Nowatari.H et al., "60.2: Intermediate Connector With Suppressed Voltage Loss for White Tandem OLEDS". SID Digest '09 : SID International Symposium Digest of Technical Papers, May 31, 2009, vol. 40, pp. 899-902.
Oba.F et al., "Defect energetics in ZnO: A hybrid Hartree-Fock density functional study", Phys. Rev. B (Physical Review. B), 2008, vol. 77, pp. 245202-1-245202-6.
Oh.M et al., "Improving the Gate Stability of ZnO Thin-Film Transistors With Aluminum Oxide Dielectric Layers", J. Electrochem. Soc. (Journal of The Electrochemical Society), 2008, vol. 155, No. 12, pp. H1009-H1014.
Ohara.H et al., "21.3:4.0 In. QVGA AMOLED Display Using In-Ga-Zn-Oxide TFTs With a Novel Passivation Layer", SID Digest '09 : SID International Symposium Digest of Technical Papers, May 31, 2009, pp. 284-287.
Ohara.H et al., "Amorphous In-Ga-Zn-Oxide TFTs with Suppressed Variation for 4.0 inch QVGA AMOLED Display", AM-FPD '09 Digest of Technical Papers, Jul. 1, 2009, pp. 227-230, The Japan Society of Applied Physics.
Orita.M et al., "Amorphous transparent conductive oxide InGaO3(ZnO)m (m<4):a Zn4s conductor", Philosophical Magazine, 2001, vol. 81, No.5, pp. 501-515.
Orita.M et al., "Mechanism of Electrical Conductivity of Transparent InGaZnO4", Phys. Rev. B (Physical Review. B), Jan. 15, 2000, vol. 61, No. 3, pp. 1811-1816.
Osada.T et al., "15.2: Development of Driver-Integrated Panel using Amorphous In-Ga-Zn-Oxide TFT", SID Digest '09 : SID International Symposium Digest of Technical Papers, May 31, 2009, pp. 184-187.
Osada.T et al., "Development of Driver-Integrated Panel Using Amorphous In-Ga-Zn-Oxide TFT", AM-FPD '09 Digest of Technical Papers, Jul. 1, 2009, pp. 33-36.
Park.J et al., "Amorphous Indium-Gallium-Zinc Oxide TFTs and Their Application for Large Size AMOLED", AM-FPD '08 Digest of Technical Papers, Jul. 2, 2008, pp. 275-278.
Park.J et al., "Dry etching of ZnO films and plasma-induced damage to optical properties", J. Vac. Sci. Technol. B (Journal of Vacuum Science & Technology B), Mar. 1, 2003, vol. 21, No. 2, pp. 800-803.
Park.J et al., "Electronic Transport Properties of Amorphous Indium-Gallium-Zinc Oxide Semiconductor Upon Exposure to Water", Appl. Phys. Lett. (Applied Physics Letters) , 2008, vol. 92, pp. 072104-1-072104-3.
Park.J et al., "High performance amorphous oxide thin film transistors with self-aligned top-gate structure", IEDM 09: Technical Digest of International Electron Devices Meeting, Dec. 7, 2009, pp. 191-194.
Park.J et al., "Improvements in the Device Characteristics of Amorphous Indium Gallium Zinc Oxide Thin-Film Transistors by Ar Plasma Treatment", Appl. Phys. Lett. (Applied Physics Letters) , Jun. 26, 2007, vol. 90, No. 26, pp. 262106-1-262106-3.
Park.S et al., "Challenge to Future Displays: Transparent AM-OLED Driven by Peald Grown ZnO TFT", IMID '07 Digest, 2007, pp. 1249-1252.
Park.Sang-Hee et al., "42.3: Transparent ZnO Thin Film Transistor for the Application of High Aperture Ratio Bottom Emission AM-OLED Display", SID Digest '08 : SID International Symposium Digest of Technical Papers, May 20, 2008, vol. 39, pp. 629-632.
Prins.M et al., "A Ferroelectric Transparent Thin-Film Transistor", Appl. Phys. Lett. (Applied Physics Letters) , Jun. 17, 1996, vol. 68, No. 25, pp. 3650-3652.
Sakata.J et al., "Development of 4.0-In. AMOLED Display With Driver Circuit Using Amorphous In-Ga-Zn-Oxide TFTs", IDW '09 : Proceedings of the 16th International Display Workshops, 2009, pp. 689-692.
Son.K et al., "42.4L: Late-News Paper: 4 Inch QVGA AMOLED Driven by the Threshold Voltage Controlled Amorphous GIZO (Ga2O3—In2O3—ZnO) TFT", SID Digest '08 : SID International Symposium Digest of Technical Papers, May 20, 2008, vol. 39, pp. 683-636.
Takahashi.M et al., "Theoretical Analysis of IGZO Transparent Amorphous Oxide Semiconductor", IDW '08 : Proceedings of the 15th International Display Workshops, Dec. 3, 2008, pp. 1637-1640.
Tsuda.K et al., "Ultra Low Power Consumption Technologies for Mobile TFT-LCDs ", IDW '02 : Proceedings of the 9th International Display Workshops, Dec. 4, 2002, pp. 295-298.
Ueno.K et al., "Field-Effect Transistor on SrTiO3 With Sputtered Al2O3 Gate Insulator", Appl. Phys. Lett. (Applied Physics Letters) , Sep. 1, 2003, vol. 83, No. 9, pp. 1755-1757.
Van de Walle.C, "Hydrogen as a Cause of Doping in Zinc Oxide", Phys. Rev. Lett. (Physical Review Letters), Jul. 31, 2000, vol. 85, No. 5, pp. 1012-1015.

* cited by examiner

DISPLAY CORRECTION CIRCUIT, DISPLAY CORRECTION SYSTEM, AND DISPLAY DEVICE

BACKGROUND OF THE INVENTION

1. Field of the Invention

One embodiment of the present invention relates to a display correction circuit, particularly a display correction circuit including an oxide semiconductor. One embodiment of the present invention relates to a display correction system including the display correction circuit. Note that one embodiment of the present invention is not limited to the technical field. The technical field of one embodiment of the invention disclosed in this specification and the like relates to an object, a method, or a manufacturing method. One embodiment of the present invention relates to a process, a machine, manufacture, or a composition of matter. Specific examples of the technical field of one embodiment of the present invention disclosed in this specification include a semiconductor device, a display device, a light-emitting device, a power storage device, a memory device, a method for driving any of them, and a method for manufacturing any of them.

2. Description of the Related Art

In recent years, smartphones have been widespread as portable devices. A large display for smartphones is accordingly needed in the market, and a recent mainstream size is 4 inch to 6 inch. Furthermore, many smartphones using an organic EL panel are coming on the market. An organic EL panel has features of flexibility and higher color purity than liquid-crystal panels and is being developed.

Unlike a liquid crystal driven by alternating current, direct voltage or direct current is applied to an organic EL element, a polysilicon transistor, or an oxide semiconductor transistor that are used in an organic EL panel. The organic EL element and transistor to which direct voltage or direct current is applied thus tend to fluctuate in characteristics after driven for a long time. The fluctuation in characteristics of the element appears as display unevenness on the display screen. Generally, a pixel driven for a long time decreases in luminance; thus, only a specific pixel driven for a long time decreases in luminance, which appears as burn-in on the display screen and degrades the display quality. Display unevenness is caused by variation in transistor characteristics as well.

As a measure against it, there is a method in which a correction circuit is incorporated in a pixel of an organic EL panel using a polysilicon transistor or an oxide semiconductor transistor to correct degradation and variation of the element. FIG. 1 shows a specific example of a circuit for correcting threshold of a transistor for driving an organic EL element. A pixel 100 in the circuit includes transistors 101, 102, 103, 104, and 105, a capacitor 106, an organic EL element 108, a data line 109, a power supply line 110, gate lines 111, 112, and 113, an anode line 114, and a cathode 107. Details of the correction circuit are described in Patent Document 1.

REFERENCE

Patent Document

[Patent Document 1] Japanese Published Patent Application No. 2013-137498

SUMMARY OF THE INVENTION

However, the conventional pixel configuration shown in FIG. 1 has a problem. The pixel in FIG. 1 needs many components of five transistors, one capacitor, four horizontal wirings, and two perpendicular wirings. Although there is no problem in the case where a pixel is large in size, the circuit is too big to fit in a pixel which is reduced in size and cannot be used in a high-resolution panel. In addition, the number of wiring layers needs to be increased even in the case where the circuit can fit in a pixel, and increase in cost with increase in the number of processes is inevitable.

In view of this technical background, an object of one embodiment of the present invention is to provide a display correction circuit that can perform a good display without burn-in on a high-resolution organic EL panel. An object of one embodiment of the present invention is to provide a display correction circuit that can perform correction with few transistors in a pixel of a high-resolution organic EL panel.

An object of one embodiment of the present invention is to provide a display correction system that can perform a good display without burn-in on a high-resolution organic EL panel. An object of one embodiment of the present invention is to provide a display correction system that can perform correction with few transistors in a pixel of a high-resolution organic EL panel.

Another object of one embodiment of the present invention is to provide a novel semiconductor device. Note that these objects do not disturb other objects. One embodiment of the present invention does not necessarily achieve all the objects. Other objects will be apparent from and can be derived from the specification, the drawings, the claims, and the like.

One embodiment of the present invention is a display correction circuit of the display device including a display region with pixels arranged in a matrix. The display correction circuit is provided outside the display region and includes a capacitor configured to input a driving current of a pixel, an oxide semiconductor transistor configured to reset the potential of the capacitor, a buffer circuit connected to the capacitor, an AD converter configured to AD-convert an output of the buffer circuit, and an output circuit configured to sequentially output a data output from the AD converter.

One embodiment of the present invention is a display correction system of the display device including a display region with pixels arranged in a matrix. The display correction system includes a display correction circuit provided outside the display region and including a capacitor configured to input an output current of a pixel, an oxide semiconductor transistor configured to reset the potential of the capacitor, a buffer circuit connected to the capacitor, an AD converter configured to AD-convert an output of the buffer circuit, and an output circuit configured to sequentially output a data output from the AD converter; an image processing circuit configured to form a correction data from an output result of the output circuit and correct a video signal using the correction data; and a memory configured to store the correction data.

Another embodiment of the present invention is a display device including the display correction circuit and a display region including pixels arranged in a matrix. The display correction circuit is positioned outside the display region. Another embodiment of the present invention is a display device including the display correction circuit; an image processing circuit configured to form a correction data from an output result of the output circuit and correct a video signal using the correction data; a memory configured to store the correction data; and a display region including pixels arranged in a matrix. The display correction circuit is positioned outside the display region.

The driving current of the pixel may be 100 nA or smaller. The pixel preferably includes an organic EL element.

One embodiment of the present invention can provide a display correction circuit that can perform a good display without burn-in on a high-resolution organic EL panel. One embodiment of the present invention can provide a display correction circuit that can perform correction with few transistors in a pixel of a high-resolution organic EL panel.

One embodiment of the present invention can provide a display correction system that can perform a good display without burn-in on a high-resolution organic EL panel. One embodiment of the present invention can provide a display correction system that can perform correction with few transistors in a pixel of a high-resolution organic EL panel. A novel semiconductor device can be provided. Note that these effects do not disturb other effects. One embodiment of the present invention does not necessarily achieve all the objects. Other effects will be apparent from and can be derived from the specification, the drawings, the claims, and the like.

DETAILED DESCRIPTION OF THE INVENTION

Figure 1:
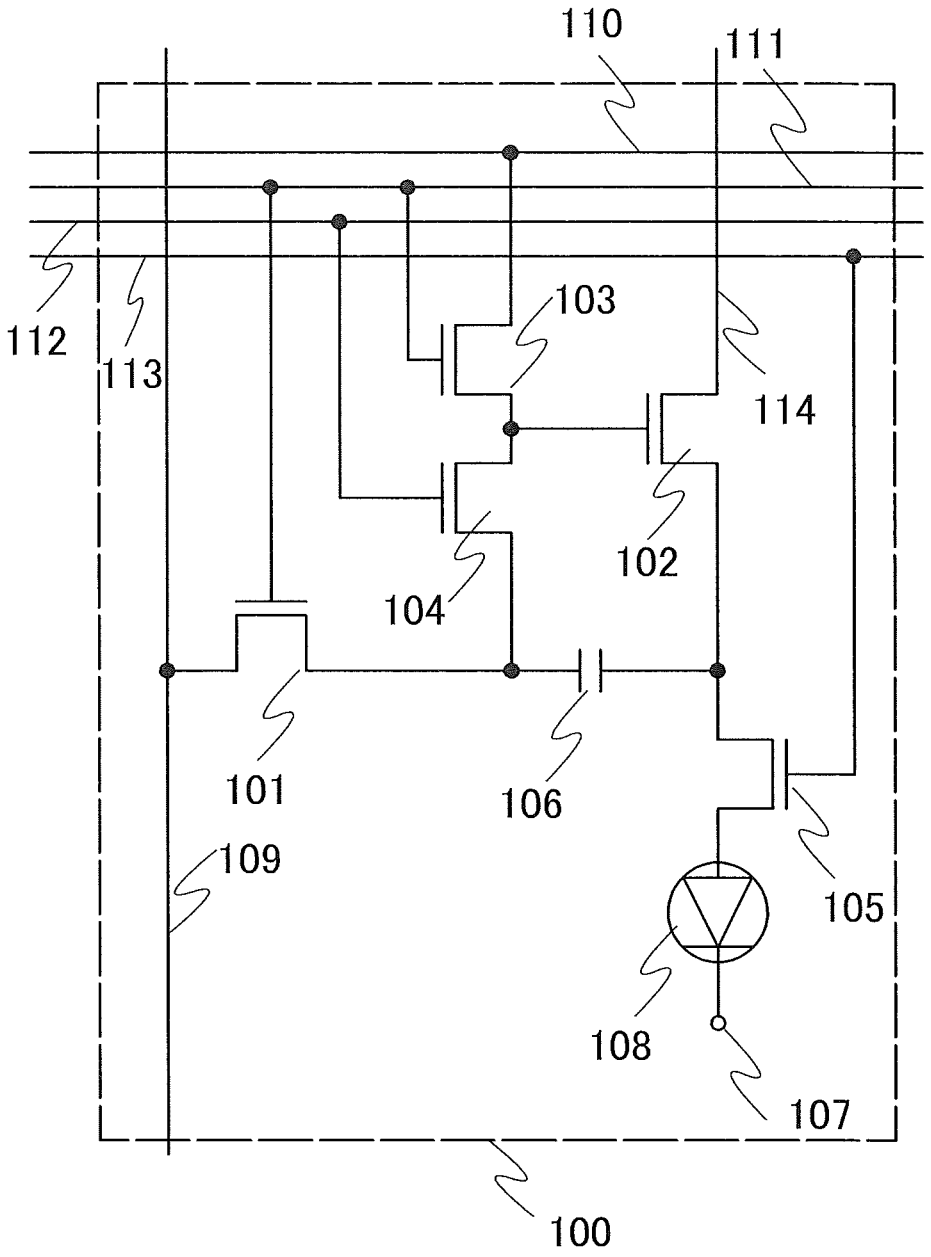
FIG. 1 is a diagram of a conventional pixel correction circuit.

Hereinafter, embodiments of the present invention will be described with reference to the drawings. Note that the present invention is not limited to the following description and it will be readily appreciated by those skilled in the art that modes and details can be modified in various ways without departing from the spirit and the scope of the present invention. Accordingly, the present invention should not be interpreted as being limited to the content of the embodiments below.

A transistor is a kind of semiconductor elements and can achieve amplification of current or voltage, switching operation for controlling conduction or non-conduction, or the like. A transistor in this specification includes an insulated-gate field effect transistor (IGFET) and a thin film transistor (TFT).

Note that the position, the size, the range, or the like of each structure illustrated in the drawings and the like is not accurately represented in some cases for simplification. Therefore, the disclosed invention should not be necessarily limited to the position, the size, the range, or the like disclosed in the drawings and the like.

In this specification and the like, ordinal numbers such as "first", "second", "third", and the like are used in order to avoid confusion among components, and the terms do not limit the components numerically.

For example, in this specification and the like, when it is explicitly described that X and Y are connected, the case where X and Y are electrically connected, the case where X and Y are functionally connected, and the case where X and Y are directly connected are included therein without limitation to the connection relation shown in the drawings and texts. Accordingly, another element which is not shown in the drawings and texts may be provided between elements having a connection shows therein.

Here, X and Y each denote an object (e.g., a device, an element, a circuit, a line, an electrode, a terminal, a conductive film, and a layer).

In the case where X and Y are electrically connected, one or more elements that enables electrical connection between X and Y (e.g., a switch, a transistor, a capacitor, an inductor, a resistor, a diode, a display element, a light-emitting element, and a load) can be connected between X and Y. Note that a switch is configured to be turned on and off. That is, whether current flows through the switch is determined by switching the conduction and non-conduction. The switch may be configured to select and change a current path.

In the case where X and Y are functionally connected, one or more circuits that enable functional connection between X and Y (e.g., a logic circuit such as an inverter, a NAND circuit, or a NOR circuit; a signal converter circuit such as a DA converter circuit, an AD converter circuit, or a gamma correction circuit; a potential level converter circuit such as a power supply circuit (e.g., a dc-dc converter, a step-up dc-dc converter, or a step-down dc-dc converter) or a level shifter circuit for changing the potential level of a signal; a voltage source; a current source; a switching circuit; an amplifier circuit such as a circuit that can increase signal amplitude, the amount of current, or the like, an operational amplifier, a differential amplifier circuit, a source follower circuit, or a buffer circuit; a signal generation circuit; a memory circuit; and/or a control circuit) can be connected between X and Y. Note that in the case where a signal output from X is transmitted to Y even when another circuit is provided between X and Y, X and Y are functionally connected.

Note that when it is explicitly described that X and Y are electrically connected, the case where X and Y are electrically connected (i.e., the case where X and Y are connected with another element or another circuit provided therebetween), the case where X and Y are functionally connected (i.e., the case where X and Y are functionally connected with another circuit provided therebetween), and the case where X and Y are directly connected (i.e., the case where X and Y are connected without another element or another circuit provided therebetween) are included therein. That is, an explicit description of "X and Y are electrically connected" is the same as an explicit description of "X and Y are connected".

Note that the case where a source (or a first terminal or the like) of a transistor is electrically connected to X through (or not through) Z1 and a drain (or a second terminal or the like) of the transistor is electrically connected to Y through (or not through) Z2, or the case where a source (or a first terminal or the like) of a transistor is directly connected to one part of Z1 and another part of Z1 is directly connected to X while a drain (or a second terminal or the like) of the transistor is directly connected to one part of Z2 and another part of Z2 is directly connected to Y, can be expressed as follows.

For example, "X, Y, a source (or a first terminal or the like) of a transistor, and a drain (or a second terminal or the like) of the transistor are electrically connected to each other, and X, the source (or the first terminal or the like) of the transistor, the drain (or the second terminal or the like) of the transistor, and Y are electrically connected to each other in this order", "a source (or a first terminal or the like) of a transistor is electrically connected to X, a drain (or a second terminal or the like) of the transistor is electrically connected to Y, and X, the source (or the first terminal or the like) of the transistor, the drain (or the second terminal or the like) of the transistor, and Y are electrically connected to each other in this order", and "X is electrically connected to Y through a source (or a first terminal or the like) and a drain (or a second terminal or the like) of a transistor, and X, the source (or the first terminal or the like) of the transistor, the drain (or the second terminal or the like) of the transistor, and Y are provided to be connected in this order". When the connection order in a circuit configuration is defined by an expression similar to the above examples, a source (or a first terminal or the like) and a drain (or a second terminal or the like) of a transistor can be distinguished from each other to specify the technical scope. Note that these expressions are non-limiting examples. Here, X, Y, Z1, and Z2 each denote an object (e.g., a device, an element, a circuit, a wiring, an electrode, a terminal, a conductive film, and a layer).

Even when independent components are electrically connected to each other in a circuit diagram, one component has functions of a plurality of components in some cases. For example, when part of a wiring also functions as an electrode, one conductive film functions as the wiring and the electrode. Thus, electrical connection in this specification includes in its category one conductive film having functions of a plurality of components.

(Embodiment 1)

(Technique of One Embodiment of the Present Invention)

In one embodiment of the present invention, a display correction circuit using an oxide semiconductor is formed outside of a pixel; consequently, the number of transistors and wirings in the pixel can be reduced and display correction can be performed even in a display device with a high pixel density. Since an oxide semiconductor transistor is used as some or all of the switching transistors in the display correction circuit, a bad influence of off-state current of the switching transistors on the correction can be inhibited. The display device in the description below is an organic EL panel but is not limited thereto.

Figure 2:
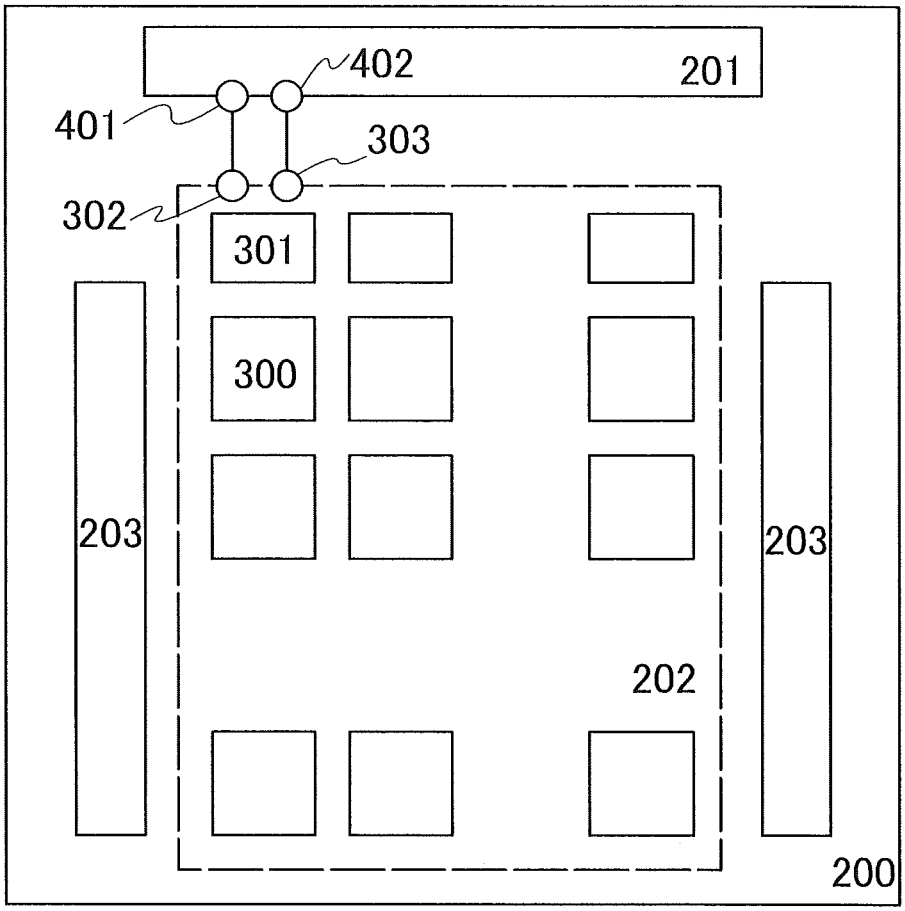
FIG. 2 is a block diagram of an organic EL panel.

Described below is an example in which the display correction circuit of one embodiment of the present invention is incorporated in a driver IC that drives data line of a pixel. FIG. 2 is a block diagram of an organic EL panel 200 which is one embodiment of the present invention. The organic EL panel 200 includes a driver IC 201, a pixel portion 202, and a gate driver circuit 203. The pixel portion 202 includes pixels 300 and a switch circuit 301. The gate driver circuit 203 is preferably integrated with the pixel portion 202 over the substrate. Generally, the driver IC 201 is mounted on a pixel substrate by a COG technique or the like. The driver IC 201 may be mounted on a substrate by tape automated bonding (TAB), or a circuit equivalent to the driver IC 201 may be integrated on a substrate.

Figure 3:
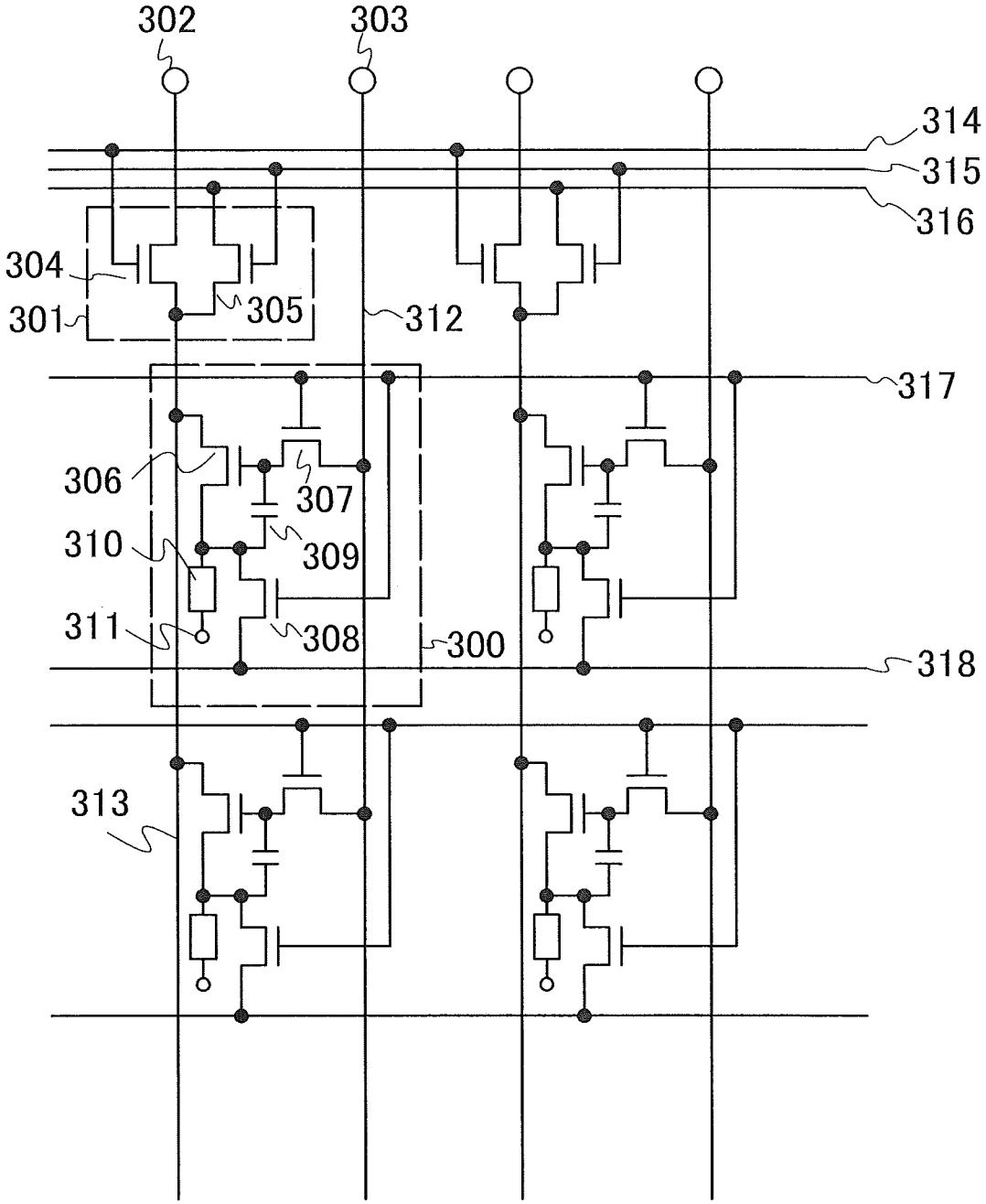
FIG. 3 is a circuit diagram of pixels in an organic EL panel.

A terminal 401 of the driver IC 201 is connected to a terminal 302 of the pixel portion 202. A terminal 402 of the driver IC 201 is connected to a terminal 303 of the pixel portion 202. FIG. 3 shows the pixel portion 202. The configuration is described below. The circuit shown in FIG. 3 is formed over an organic EL panel substrate. Transistors in the circuit are oxide semiconductor transistors, polysilicon transistors, and the like, but not limited thereto.

The pixel 300 includes transistors 306, 307, and 308, a capacitor 309, an organic EL element 310, a cathode electrode 311, a data line 312, a power supply line 313, a gate line 317, and a power line 318. The pixels 300 are arranged in a matrix in a display screen. The data line 312 is connected to the terminal 303. The power supply line 313 is connected to a source or drain of transistors 304 and 305. The other of the source and drain of the transistor 304 is connected to the terminal 302. The other of the source and drain of the transistor 305 is connected to a power line 316. A gate of the transistor 304 is connected to a control line 314. A gate of the transistor 305 is connected to a control line 315. The transistors 304 and 305 are preferably formed simultaneously with the transistors in the pixel 300. The terminals 302 and 303 are respectively connected to the terminals 401 and 402 of the driver IC 201.

Next, operation of the circuit shown in FIG. 3 is described. The transistors described here are all n-channel transistors. When p-channel transistors are employed, the polarity of electric signals may be changed. The switch circuit 301 is provided near the pixels 300. The switch circuit 301 includes the transistors 304 and 305. To display images, the control lines 315 and 314 are set to high and low, respectively. The power supply line 313 is consequently connected to the power line 316 and an anode potential is supplied to the pixels 300.

First, the gate line 317 is set to high and the transistors 307 and 308 are turned on, whereby the gate and the source of the transistor 306 are connected to the data line 312 and the power line 318, respectively. The voltage difference between the data line 312 and the power line 318 is thus stored in the capacitor 309. When the voltage of the power line 318 is set to a potential at which the organic EL element 310 is not emitted, no emission occurs in writing. Next, the gate line 317 is set to low to turn off the transistors 307 and 308. When the potential stored in the capacitor 309 is higher than the threshold of the transistor 306, current flows from the transistor 306 to the organic EL element 310, whereby the element is emitted. Writing is similarly performed in the pixels in the next row as well, whereby the organic EL elements are emitted. The organic EL elements are sequentially emitted in this manner, so that the entire organic EL panel can be emitted.

Next, operation for monitoring current in pixels is described. The control lines 315 and 314 are set to low and high, respectively. The power supply line 313 is consequently connected to the terminal 302. The gate line 317 is set to high to turn on the transistors 307 and 308, whereby the gate and the source of the transistor 306 are connected to the data line 312 and the power line 318, respectively. When the voltage of the power line 318 is set to a potential at which the organic EL element 310 is not emitted, no emission occurs in monitoring. Current flows from the driver circuit to the transistor 306 through the terminal 302 and the transistor 304 and also to the power line 318 through the transistor 308. For this reason, current flowing in the terminal 302 is monitored to monitor current in the pixel 300. After the monitoring, the control line 314 is set to low to turn off the transistor 304.

Next, a potential lower enough than that in the monitoring is input to the data line 312 to turn off the transistor 306. The gate line 317 is set to low to turn off the transistors 307 and 308. The pixels in the following rows are monitored, so that current in all the pixels can be monitored.

As compared with the pixel 100 in FIG. 1, the number of transistors in the pixel 300 shown in FIG. 3 is reduced from 5 to 3 and that of horizontal wirings is reduced from 4 to 2. Thus, the display device in Embodiment 1 achieves display correction with a reduced number of transistors.

This embodiment can be implemented in combination with any of the other embodiments as appropriate.

(Embodiment 2)

Figure 4:
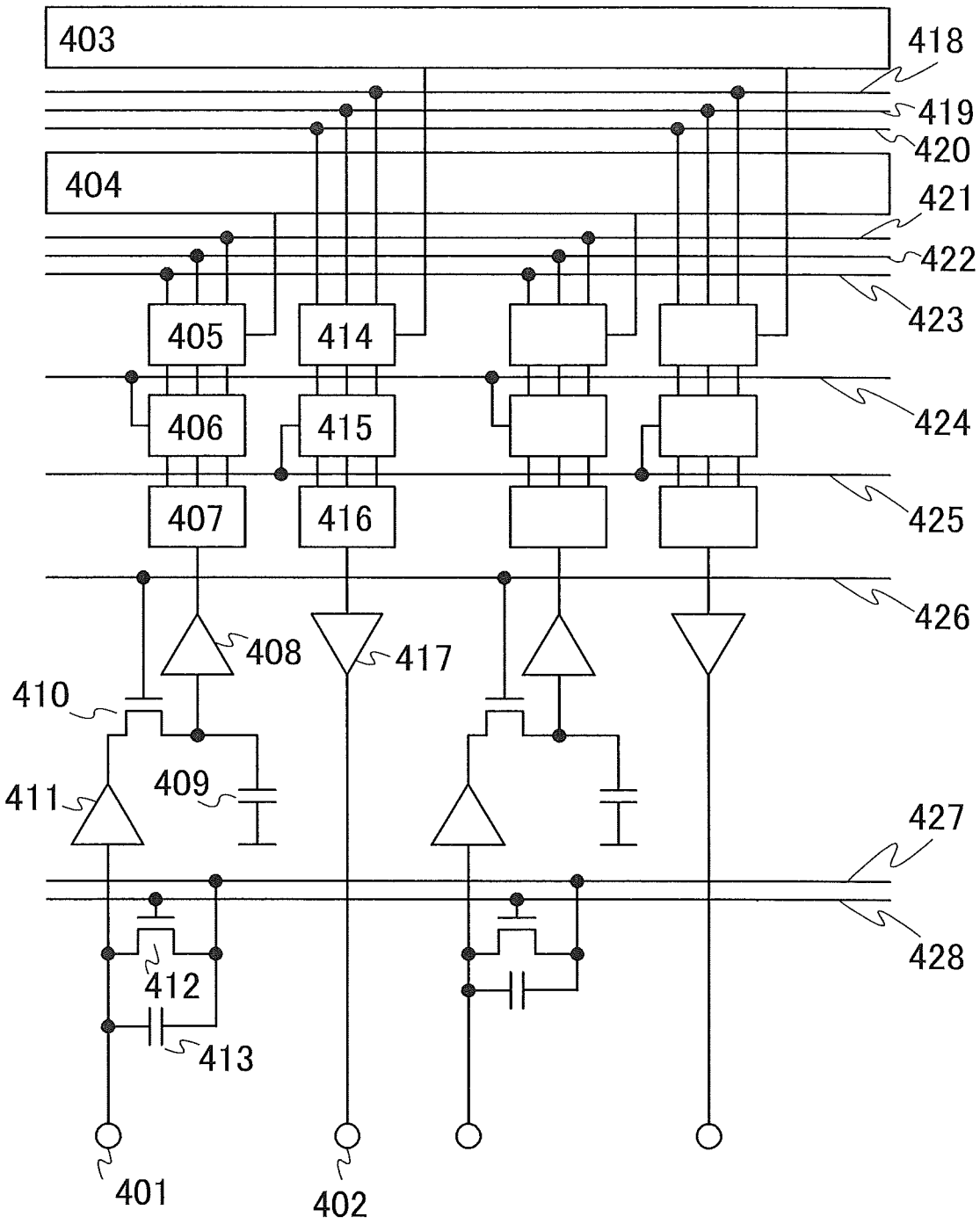
FIG. 4 is a block diagram of a display correction circuit.

The configuration of the driver IC 201 including the display correction circuit of one embodiment of the present invention is described with reference to FIG. 4. FIG. 4 is a block diagram of the driver IC 201 which has two functions of writing data and monitoring current in the pixels, for example. The two functions may be separately provided in different ICs.

First, operation of writing data is described. Writing data refers to inputting image data from the outside of a panel to pixels inside the panel. The circuit in FIG. 4 includes a writing shift register 403, a latch 414, a latch 415, a DA converter 416, an analog buffer circuit 417, signal lines 418, 419, and 420, and a control line 425. Writing data is performed in the following manner.

The writing shift register 403 shifts pulses sequentially. The output of the writing shift register 403 is input to the latch 414 to synchronize, and image data of the signal lines 418 to 420 are latched. After data for one row is latched, the control line 425 is set to high to transfer the data to the latch 415. The data is analog-converted by the DA converter 416 and output to the terminal 402 through the analog buffer circuit 417.

Figure 6:
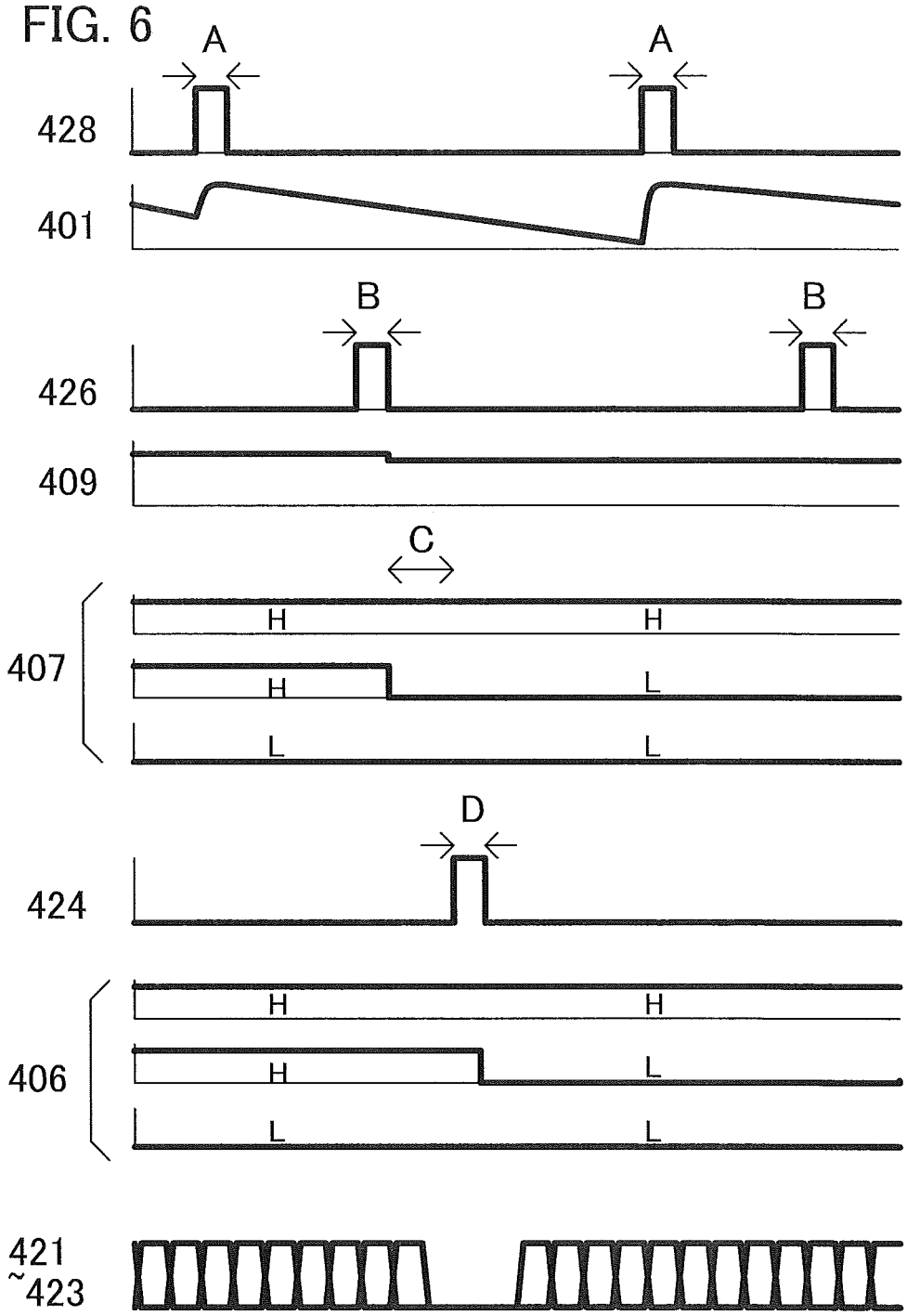
FIG. 6 is a timing chart.

Next, operation of current monitoring of the pixels is described. Current monitoring refers to outputting data of values of current flowing in the transistors 306 of the pixels to the outside of the panel. The display correction circuit in FIG. 4 includes a monitoring shift register 404, a sampling switch circuit 405, a latch 406, an AD converter 407, buffer circuits 408 and 411, transistors 410 and 412, capacitors 409 and 413, control lines 424, 426, and 428, a power line 427, and current data output signal lines 421, 422, and 423. FIG. 6 shows operation timing of the display correction circuit. The monitoring shift register 404 serves as an output circuit.

First, the control line 428 is set to high to turn on the transistor 412 (a period A in FIG. 6), whereby the terminal 401 has the same potential as the power line 427. The control line 428 is then set to low, and the transistor 412 is turned off. Next, current is drawn into in the pixel 300 which is connected to the terminal 401, whereby charge of the capacitor 413 is discharged and the potential of the terminal 401 decreases. This potential is input to the transistor 410 through the buffer circuit 411. Then, the control line 426 is set to high to turn on the transistor 410, whereby the potential of the buffer circuit 411 is written to the capacitor 409 (a period B in FIG. 6). After that, the control line 426 is set to low to turn off the transistor 410, and the potential is held in the capacitor 409.

The transistors 410 and 412 are oxide semiconductor transistors. The reason why oxide semiconductor transistors are used as these transistors will be described. Current flowing in an organic EL element per pixel is as small as 100 nA or less. In the case where the transistors 410 and 412 are silicon transistors, the off-state current is 10 nA or more, which is too large to ignore to the pixel current of 100 nA; thus, display correction cannot be accurately performed due to the off-state current. For this reason, one embodiment of the present invention uses an oxide semiconductor transistor to sufficiently reduce off-state current and accurately measure pixel current, whereby correction can be more accurately performed.

As a silicon transistor is miniaturized, the off-state current is increased, which becomes pronounced particularly when the gate length is 130 nm or shorter. However, the design rule of integrated circuits is reduced to improve the degree of integration. It is thus difficult to simultaneously achieve miniaturization and small off-state current in silicon transistors, whereas oxide semiconductor transistors can achieve it.

There is another method of using such a silicon transistor with a large off-state current as a switch: pixel current is amplified 10 times or more and the capacitor 413 is also increased 10 times or more in order to relatively reduce the adverse effect of the off-state current. However, this method leads to an increase in chip area because an additional circuit for amplifying the pixel current and the large capacitance are needed. The present invention can reduce the capacitance of the capacitor 413 to 0.2 pF or less and does not need to increase chip area.

Figure 7:
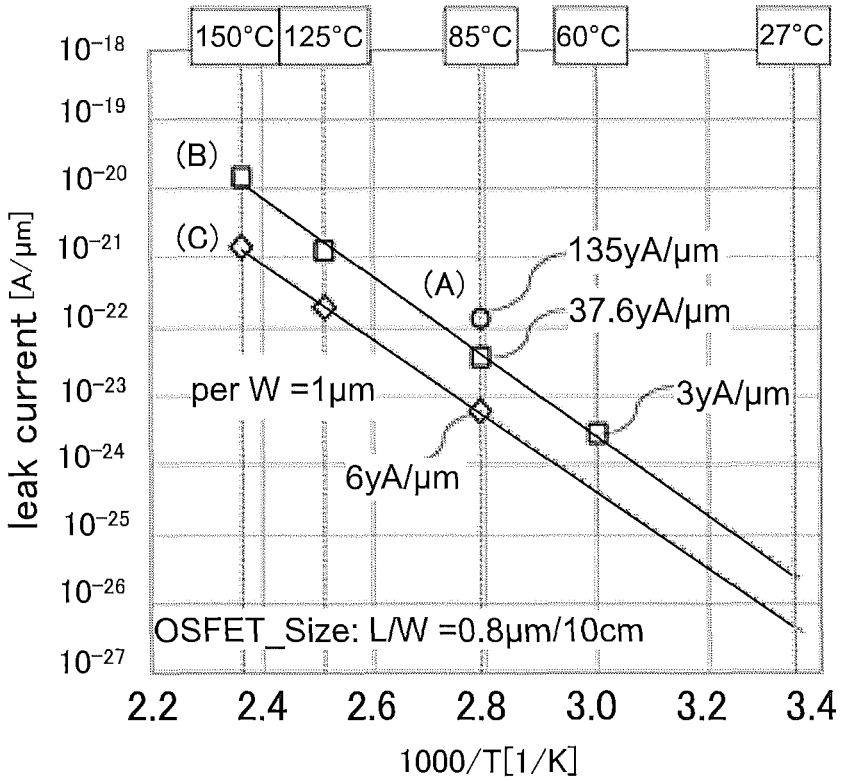
FIG. 7 shows off-state current characteristics.

FIG. 7 shows Arrhenius plot of off-state current of the oxide semiconductor transistors. Three samples A, B, and C are measured. The off-state current of an oxide semiconductor using a CAAC film which is described below is as small as 1 zA ($1\times10^{-21}$ A) or smaller even at 85° C.; thus, the off-state current values do not affect the above-described specification.

The output of the buffer circuit 408 is input to the AD converter 407 and is converted into a digital signal (a period C in FIG. 6). Although the AD converter in FIG. 4 is 3 bit, the number of bits may be larger without limitation thereto. The control line 424 is set to high, whereby the output of the AD converter is latched by the latch 406 (a period D in FIG. 6). The sampling switch circuit 405 operates depending on the output of the monitoring shift register 404 to transfer it to the current data output signal lines 421 to 423.

This embodiment can be implemented in combination with any of the other embodiments as appropriate.

(Embodiment 3)

Figure 5:
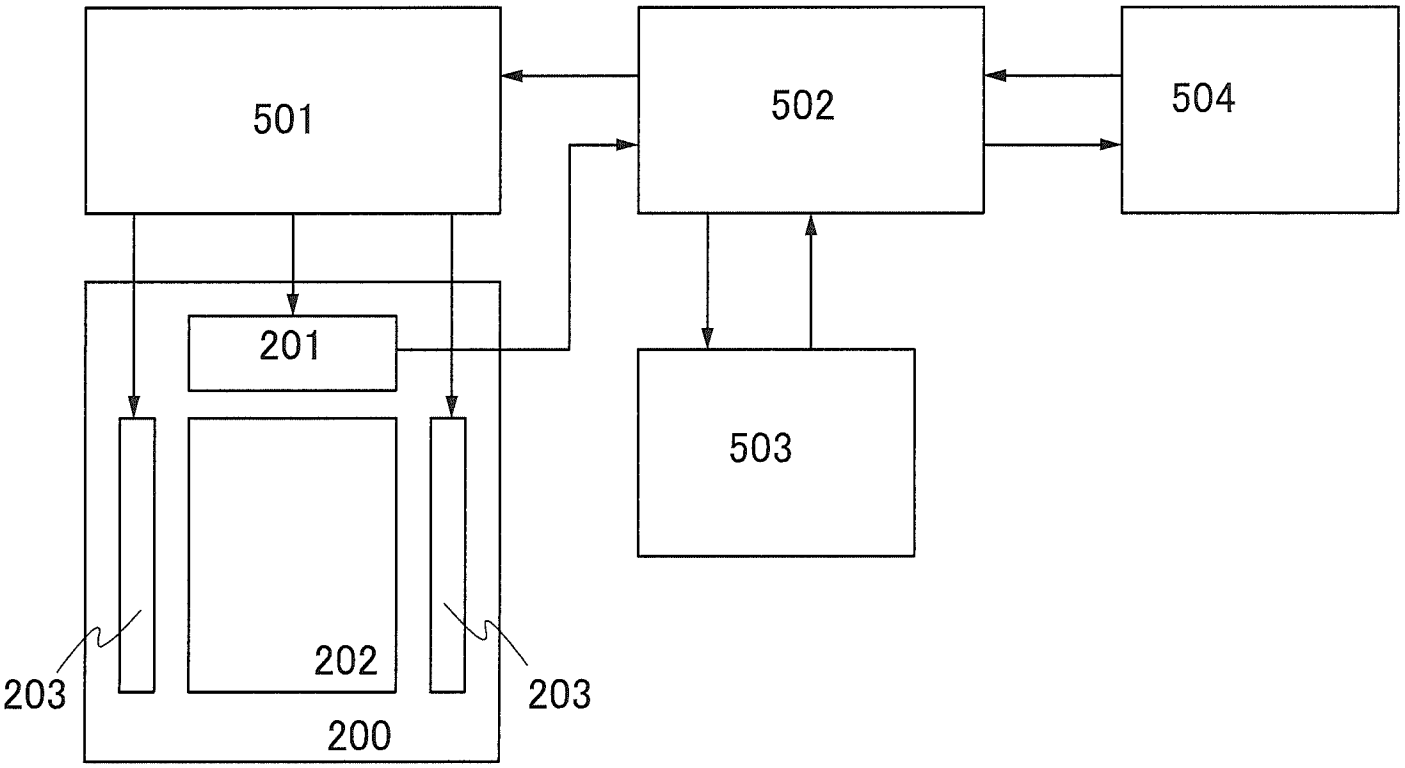
FIG. 5 is a block diagram of a display correction system.

FIG. 5 is a block diagram of correction system of one embodiment of the present invention. The correction system includes an organic EL panel 200, a controller 501, an image signal processing circuit 502, a memory 503, and a CPU 504. The memory 503 may be incorporated in the image signal processing circuit 502. The memory stores data and can be used as a lookup table.

Operation is described. First, current in each pixel of the organic EL panel 200 is monitored in the above-described manner. Data obtained by the monitoring is output from the driver IC 201 and stored in the memory 503 used as a lookup table through the image signal processing circuit 502. The image signal processing circuit 502 corrects image signals using the stored data. For example, an image signal is corrected in a pixel where more current flows by 5% of the average so that the data can be written with less current by 5% of the average. The CPU 504 determines when to monitor for correction. The corrected image data is input to the driver IC 201 through the controller 501, and the organic EL panel 200 can consequently display the corrected data, so that high-image-quality display without burn-in can be obtained.

It is suitable to monitor all of the pixels shortly before the organic EL display is powered off, shortly after the organic EL display is powered on, and the like because it takes too long to monitor all of the pixels in a display period. There is no problem if display cannot be performed in these periods. The current monitoring may be performed when a screen saver comes up because a monitor of a portable device is generally turned off by the screen saver.

Using the display correction circuit of one embodiment of the present invention, high-accuracy correction can be achieved and high-definition pixels can be fabricated with a reduced number of transistors and wirings in the pixels.

This embodiment can be implemented in combination with any of the other embodiments as appropriate.

(Embodiment 4)

In Embodiment 4, an oxide semiconductor layer that can be used as a semiconductor layer of the transistor with low off-state current described in the above embodiment is described.

An oxide semiconductor having a small off-state current used for a channel formation region in the semiconductor layer of the transistor preferably contains at least indium (In) or zinc (Zn). In particular, In and Zn are preferably contained. A stabilizer for strongly bonding oxygen is preferably contained in addition to In and Zn. As a stabilizer, at least one of gallium (Ga), tin (Sn), zirconium (Zr), hafnium (Hf), and aluminum (Al) may be contained.

As another stabilizer, one or plural kinds of lanthanoid such as lanthanum (La), cerium (Ce), praseodymium (Pr), neodymium (Nd), samarium (Sm), europium (Eu), gadolinium (Gd), terbium (Tb), dysprosium (Dy), hohnium (Ho), erbium (Er), thulium (Tm), ytterbium (Yb), and lutetium (Lu) may be contained.

As the oxide semiconductor used for the semiconductor layer of the transistor, for example, any of the following can be used: indium oxide, tin oxide, zinc oxide, an In—Zn-based oxide, a Sn—Zn-based oxide, an Al—Zn-based oxide, a Zn—Mg-based oxide, a Sn—Mg-based oxide, an In—Mg-based oxide, an In—Ga-based oxide, an In—Ga—Zn-based oxide (also referred to as IGZO), an In—Al—Zn-based oxide, an In—Sn—Zn-based oxide, a Sn—Ga—Zn-based oxide, an Al—Ga—Zn-based oxide, a Sn—Al—Zn-based oxide, an In—Hf—Zn-based oxide, an In—Zr—Zn-based oxide, an In—Ti—Zn-based oxide, an In—Sc—Zn-based oxide, an In—Y—Zn-based oxide, an In—La—Zn-based oxide, an In—Ce—Zn-based oxide, an In—Pr—Zn-based oxide, an In—Nd—Zn-based oxide, an In—Sm—Zn-based oxide, an In—Eu—Zn-based oxide, an In—Gd—Zn-based oxide, an In—Tb—Zn-based oxide, an In—Dy—Zn-based oxide, an In—Ho—Zn-based oxide, an In—Er—Zn-based oxide, an In—Tm—Zn-based oxide, an In—Yb—Zn-based oxide, an In—Lu—Zn-based oxide, an In—Sn—Ga—Zn-based oxide, an In—Hf—Ga—Zn-based oxide, an In—Al—Ga—Zn-based oxide, an In—Sn—Al—Zn-based oxide, an In—Sn—Hf—Zn-based oxide, and an In—Hf—Al—Zn-based oxide.

For example, an In—Ga—Zn-based oxide with an atomic ratio of In:Ga:Zn=1:1:1, 3:1:2, or 2:1:3, or an oxide with an atomic ratio close to the above atomic ratios can be used.

When the oxide semiconductor film forming the semiconductor layer contains a large amount of hydrogen, the hydrogen and the oxide semiconductor are bonded to each other, so that part of the hydrogen serves as a donor and causes generation of an electron that is a carrier. As a result, the threshold voltage of the transistor shifts in the negative direction. Therefore, it is preferable that; after formation of the oxide semiconductor film, dehydration treatment (dehydrogenation treatment) be performed to remove hydrogen or moisture from the oxide semiconductor film so that the oxide semiconductor film is highly purified to contain impurities as little as possible.

Note that oxygen in the oxide semiconductor film is also reduced by the dehydration treatment (dehydrogenation treatment) in some cases. Therefore, it is preferable that oxygen whose amount is reduced in the dehydration treatment (dehydrogenation treatment) be added to the oxide semiconductor or oxygen be supplied excessively to fill the oxygen vacancies in the oxide semiconductor film. In this specification and the like, supplying oxygen to an oxide semiconductor film may be expressed as oxygen adding treatment or treatment for making an oxygen-excess state.

In this manner, hydrogen or moisture is removed from the oxide semiconductor film by the dehydration treatment (dehydrogenation treatment) and oxygen vacancies therein are filled by the oxygen adding treatment, whereby the oxide semiconductor film can be turned into an i-type (intrinsic) oxide semiconductor film or a substantially i-type (intrinsic) oxide semiconductor film which is extremely close to an i-type oxide semiconductor film. Note that "substantially intrinsic" means that the oxide semiconductor film contains extremely few (close to zero) carriers derived from a donor and has a carrier density which is $1\times10^{17}/cm^3$ or lower, $1\times10^{16}/cm^3$ or lower, $1\times10^{15}/cm^3$ or lower, $1\times10^{14}/cm^3$ or lower, or $1\times10^{13}/cm^3$ or lower.

In this manner, the transistor including an i-type (intrinsic) or substantially i-type oxide semiconductor film can have extremely favorable off-state current characteristics. For example, the drain current at the time when the transistor including an oxide semiconductor film is in an off-state at room temperature (approximately 25° C.) can be less than or equal to $1\times10^{-18}$ A, less than or equal to $1\times10^{-21}$ A, or less than or equal to $1\times10^{-24}$ A; or at 85° C., less than or equal to $1\times10^{-15}$ A, less than or equal to $1\times10^{-18}$ A, or less than or equal to $1\times10^{-21}$ A. Note that the off state of an n-channel transistor refers to a state where a gate voltage is sufficiently lower than the threshold voltage. Specifically, the transistor is off when the gate voltage is lower than the threshold voltage by 1 V or more, 2 V or more, or 3 V or more.

The oxide semiconductor film may include one or more of an oxide semiconductor having a single-crystal structure (hereinafter referred to as a single-crystal oxide semiconductor), an oxide semiconductor having a polycrystalline structure (hereinafter referred to as a polycrystalline oxide semiconductor), an oxide semiconductor having a microcrystalline structure (hereinafter referred to as a microcrystalline oxide semiconductor), and an oxide semiconductor having an amorphous structure (hereinafter referred to as an amorphous oxide semiconductor). The oxide semiconductor film may include a CAAC-OS. The oxide semiconductor film may include an amorphous oxide semiconductor and an oxide semiconductor having a crystal grain. Described below is a CAAC-OS film as a typical example.

The CAAC-OS film is an oxide semiconductor film having a plurality of c-axis aligned crystal parts.

In a transmission electron microscope (TEM) image of the CAAC-OS film, a boundary between crystal parts, that is, a grain boundary is not clearly observed. Thus, in the CAAC-OS film, a reduction in electron mobility due to the grain boundary is less likely to occur.

In the TEM image of the CAAC-OS film observed in a direction substantially parallel to a sample surface (cross-sectional TEM image), metal atoms are arranged in a layered manner in the crystal parts. Each metal atom layer has a morphology reflecting a surface over which the CAAC-OS film is formed (hereinafter, a surface over which the CAAC-OS film is formed is referred to as a formation surface) or a top surface of the CAAC-OS film, and is parallel to the formation surface or the top surface of the CAAC-OS film In the TEM image of the CAAC-OS film observed in a direction substantially perpendicular to the sample surface (plan TEM image), metal atoms are arranged in a triangular or hexagonal configuration in the crystal parts. However, there is no regularity of arrangement of metal atoms between different crystal parts.

A CAAC-OS film is subjected to structural analysis with an X-ray diffraction (XRD) apparatus. For example, when the CAAC-OS film including an $InGaZnO_4$ crystal is analyzed by an out-of-plane method, a peak appears frequently when the diffraction angle (2θ) is around 31°. This peak is derived from the (009) plane of the $InGaZnO_4$ crystal, which indicates that crystals in the CAAC-OS film have c-axis alignment, and that the c-axes are aligned in a direction substantially perpendicular to the formation surface or the top surface of the CAAC-OS film In the case where the CAAC-OS film is analyzed by an in-plane method in which an X-ray enters a sample in a direction substantially perpendicular to the c-axis, a peak appears frequently when 2θ is around 56°. This peak is derived from the (110) plane of the $InGaZnO_4$ crystal. Here, analysis (φ scan) is performed under conditions where the sample is rotated around a normal vector of a sample surface as an axis (φ axis) with 2θ fixed at around 56°. In the case where the sample is a single-crystal oxide semiconductor film of $InGaZnO_4$, six peaks appear. The six peaks are derived from crystal planes equivalent to the (110) plane. On the other hand, in the case of a CAAC-OS film, a peak is not clearly observed even when φ scan is performed with 2θ fixed at around 56°.

These results show that in the CAAC-OS film having c-axis alignment, while the directions of a-axes and b-axes are irregularly oriented between crystal parts, the c-axes are aligned in a direction parallel to a normal vector of a formation surface or a normal vector of a top surface. Thus, each metal atom layer arranged in a layered manner observed in the cross-sectional TEM image corresponds to a plane parallel to the a-b plane of the crystal.

The CAAC-OS film is an oxide semiconductor film having low impurity concentration. The impurity is an element other than the main components of the oxide semiconductor film, such as hydrogen, carbon, silicon, or a transition metal element. In particular, an element that has higher bonding strength to oxygen than a metal element included in the oxide semiconductor film, such as silicon, disturbs the atomic arrangement of the oxide semiconductor film by depriving the oxide semiconductor film of oxygen and causes a decrease in crystallinity. A heavy metal such as iron or nickel, argon, carbon dioxide, or the like has a large atomic radius (molecular radius), and thus disturbs the atomic arrangement of the oxide semiconductor film and causes a decrease in crystallinity when it is contained in the oxide semiconductor film. Note that the impurity contained in the oxide semiconductor film might serve as a carrier trap or a carrier generation source.

The CAAC-OS film is an oxide semiconductor film having a low density of defect states. In some cases, oxygen vacancies in the oxide semiconductor film serve as carrier traps or serve as carrier generation sources when hydrogen is captured therein.

The state in which impurity concentration is low and density of defect states is low (the number of oxygen vacancies is small) is referred to as a "highly purified intrinsic" or "substantially highly purified intrinsic" state. A highly purified intrinsic or substantially highly purified intrinsic oxide semiconductor film has few carrier generation sources, and thus can have a low carrier density. Thus, a transistor including the oxide semiconductor film rarely has negative threshold voltage (is rarely normally on). The highly purified intrinsic or substantially highly purified intrinsic oxide semiconductor film has a low density of defect states, and thus has few carrier traps. Accordingly, the transistor including the oxide semiconductor film has little variation in electrical characteristics and high reliability. Electric charge trapped by the carrier traps in the oxide semiconductor film takes a long time to be released, and might behave like fixed electric charge. Thus, the transistor which includes the oxide semiconductor film having high impurity concentration and a high density of defect states has unstable electrical characteristics in some cases.

In a transistor using the CAAC-OS film, changes in electrical characteristics due to irradiation with visible light or ultraviolet light are small.

This embodiment can be implemented in combination with any of the other embodiments as appropriate.

(Embodiment 5)

In Embodiment 5, an example of a cross-sectional structure of a transistor used in a semiconductor device of one embodiment of the disclosed invention will be described with reference to drawings.

Figure 8:
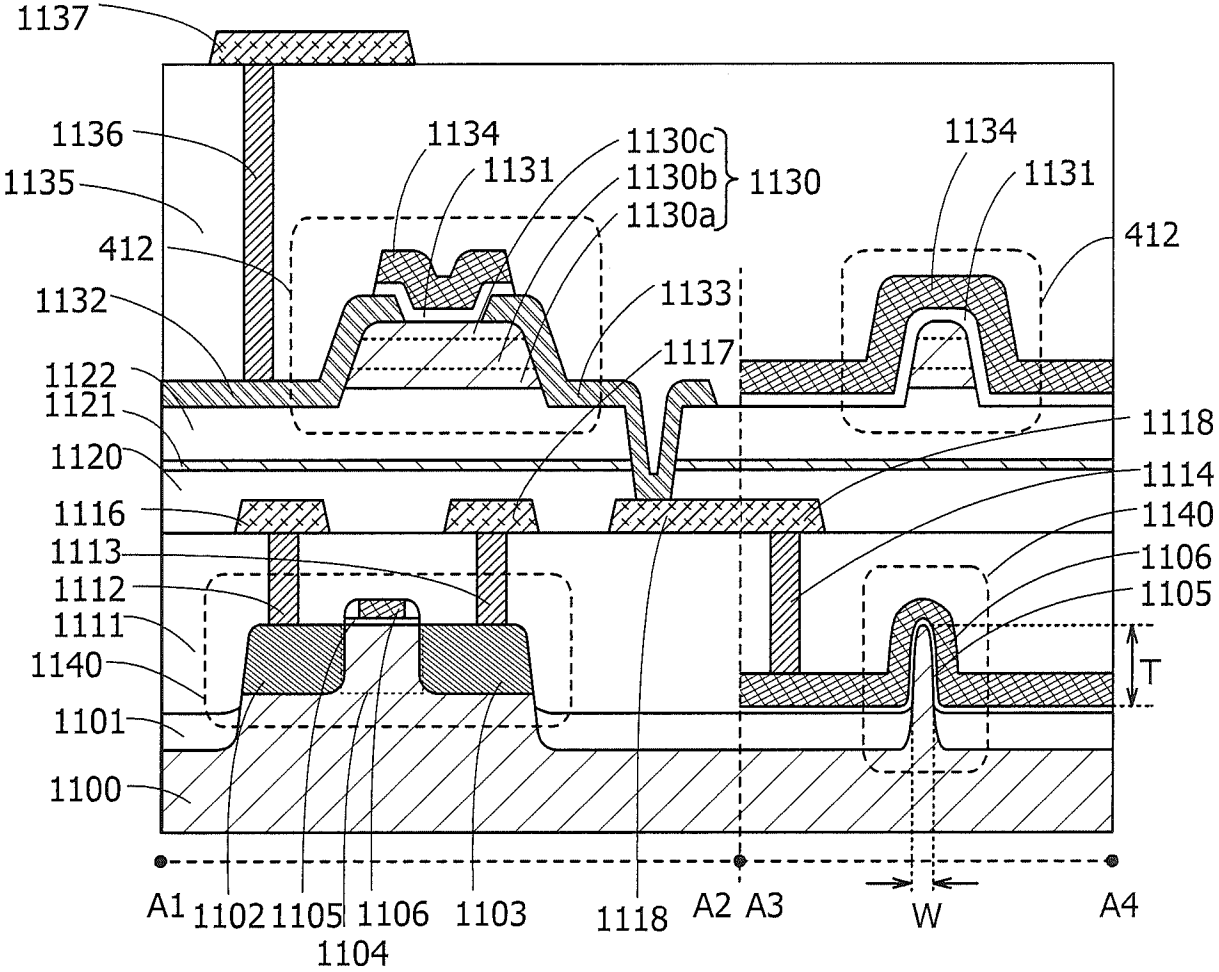
FIG. 8 is a cross-sectional view of one embodiment of the present invention.

FIG. 8 illustrates an example of a cross-sectional structure of part of a circuit portion in one embodiment of the present invention. Note that the cross-sectional structures of the transistor 412 including an oxide semiconductor described in Embodiment 2 and FIG. 4 and a transistor 1140 containing single crystal silicon and included in the buffer circuit 411 are illustrated in FIG. 8. A region between A1 and A2 corresponds to a structure of the transistors 412 and 1140 in the channel length direction, and a region between A3 and A4 corresponds to a structure of the transistors 412 and 1140 in the channel width direction. Note that in one embodiment of the present invention, the channel length direction of the transistor 412 is not necessarily aligned with the channel length direction of the transistor 1140.

The channel length direction denotes a direction in which carriers move at the shortest distance between a pair of impurity regions serving as a source region and a drain region. The channel width direction denotes a direction perpendicular to the channel length direction.

FIG. 8 illustrates an example in which the transistor 412 including a channel formation region in an oxide semiconductor film is formed over the transistor 1140 including a channel formation region in a single crystal silicon substrate. With the structure illustrated in FIG. 8, the transistor 412 and the transistor 1140 can overlap with each other. Alternatively, the channel formation region of the transistor 412 and the channel formation region of the transistor 1140 can overlap with each other. Thus, the structure can reduce the layout area of a semiconductor device.

The transistor 1140 may include a channel formation region in a semiconductor film or a semiconductor substrate of silicon, germanium, or the like in an amorphous, microcrystalline, polycrystalline, or single crystal state. Alternatively, the transistor 1140 may include the channel formation region in an oxide semiconductor film or an oxide semiconductor substrate. In the case where the transistors each include a channel formation region in an oxide semiconductor film or an oxide semiconductor substrate, the transistor 412 is not necessarily stacked over the transistor 1140, and the transistor 412 and the transistor 1140 may be formed in the same layer.

In the case where the transistor 1140 is formed using a thin silicon film, any of the following can be used in the thin film-amorphous silicon formed by a sputtering method or a vapor phase growth method such as a plasma-enhanced chemical vapor deposition (CVD) method; polycrystalline silicon obtained by crystallization of amorphous silicon by treatment such as laser annealing; single crystal silicon obtained by separation of a surface portion of a single crystal silicon wafer by implantation of hydrogen ions or the like into the silicon wafer; and the like.

A substrate 1100 where the transistor 1140 is formed can be, for example, a silicon substrate, a germanium substrate, or a silicon germanium substrate. In FIG. 8, a single crystal silicon substrate is used as the substrate 1100.

The transistor 1140 is electrically isolated by element isolation. Trench isolation (e.g., shallow trench isolation (STI)) or the like can be used as the element isolation. In FIG. 8, the transistor 1140 is electrically isolated by trench isolation. Specifically, in FIG. 8, the transistor 1140 is electrically isolated by element isolation using an element isolation region 1101 formed in such a manner that an insulator including silicon oxide or the like is buried in a trench formed in the substrate 1100 by etching or the like and then the insulator is removed partly by etching or the like.

In a projection of the substrate 1100 that exists in a region other than the trench, an impurity region 1102 and an impurity region 1103 of the transistor 1140 and a channel formation region 1104 placed between the impurity regions 1102 and 1103 are provided. The transistor 1140 also includes an insulating film 1105 covering the channel formation region 1104 and a gate electrode 1106 that overlaps the channel formation region 1104 with the insulating film 1105 placed therebetween.

In the transistor 1140, a side portion and an upper portion of the projection in the channel formation region 1104 overlap with the gate electrode 1106 with the insulating film 1105 positioned therebetween, so that carriers flow in a wide area including the side portion and the upper portion of the channel formation region 1104. Thus, the area of the transistor 1140 in the substrate can be small, and the amount of transfer of carriers in the transistor 1140 can be increased. As a result, the on-state current and field-effect mobility of the transistor 1140 are increased. Suppose the length in the channel width direction (channel width) of the projection in the channel formation region 1104 is W, and the thickness of the projection in the channel formation region 1104 is T. When the aspect ratio of the thickness T to the channel width W is high, a region where carriers flow becomes larger. Thus, the on-state current of the transistor 1140 can be further increased and the field-effect mobility of the transistor 1140 can be further increased.

Note that in the case of the transistor 1140 formed using a bulk semiconductor substrate, the aspect ratio is preferably 0.5 or more, more preferably 1 or more.

An insulating film 1111 is provided over the transistor 1140. Openings are formed in the insulating film 1111. Conductive films 1112 and 1113 that are electrically connected to the impurity regions 1102 and 1103, respectively, and a conductive film 1114 that is electrically connected to the gate electrode 1106 are formed in the openings.

The conductive film 1112 is electrically connected to a conductive film 1116 formed over the insulating film 1111. The conductive film 1113 is electrically connected to a conductive film 1117 formed over the insulating film 1111. The conductive film 1114 is electrically connected to a conductive film 1118 formed over the insulating film 1111.

An insulating film 1120 is provided over the conductive films 1116 to 1118. An insulating film 1121 having a blocking effect of preventing diffusion of oxygen, hydrogen, and water is provided over the insulating film 1120. As the insulating film 1121 has higher density and becomes denser or has a fewer dangling bonds and becomes more chemically stable, the insulating film 1121 has a higher blocking effect. The insulating film 1121 that has the effect of blocking diffusion of oxygen, hydrogen, and water can be formed using, for example, aluminum oxide, aluminum oxynitride, gallium oxide, gallium oxynitride, yttrium oxide, yttrium oxynitride, hafnium oxide, or hafnium oxynitride. The insulating film 1121 having an effect of blocking diffusion of hydrogen and water can be formed using, for example, silicon nitride or silicon nitride oxide.

An insulating film 1122 is provided over the insulating film 1121, and the transistor 412 is provided over the insulating film 1122.

The transistor 412 includes, over the insulating film 1122, a semiconductor film 1130 including an oxide semiconductor, conductive films 1132 and 1133 functioning as source and drain electrodes and electrically connected to the semiconductor film 1130, a gate insulating film 1131 covering the semiconductor film 1130, and a gate electrode 1134 overlapping with the semiconductor film 1130 with the gate insulating film 1131 therebetween. Note that an opening is formed in the insulating films 1120 to 1122. The conductive film 1133 is connected to the conductive film 1118 in the opening.

Note that in FIG. 8, the transistor 412 includes at least the gate electrode 1134 on one side of the semiconductor film 1130, and may further include a gate electrode overlapping with the semiconductor film 1130 with the insulating film 1122 positioned therebetween.

When the transistor 412 includes a pair of gate electrodes, a signal for controlling an on state or an off state may be input to one of the gate electrodes, and the other of the gate electrodes may be supplied with a potential. In that case, potentials with the same level may be supplied to the pair of gate electrodes, or a fixed potential such as the ground potential may be supplied only to the other of the gate electrodes. By controlling the level of a potential supplied to the other of the gate electrodes, the threshold voltage of the transistor can be controlled.

In FIG. 8, the transistor 412 has a single-gate structure in which one channel formation region corresponding to one gate electrode 1134 is provided. However, the transistor 412 may have a multi-gate structure where a plurality of electrically connected gate electrodes are provided so that a plurality of channel formation regions are included in one active layer.

FIG. 8 illustrates an example in which the semiconductor film 1130 included in the transistor 412 includes oxide semiconductor films 1130*a* to 1130*c* that are stacked in this order over the insulating film 1122. Note that in one embodiment of the present invention, the semiconductor film 1130 of the transistor 412 may be formed using a single-layer metal oxide film.

The insulating film 1122 preferably has a function of supplying part of oxygen to the oxide semiconductor films 1130*a* to 1130*c* by heating. It is preferable that the number of defects in the insulating film 1122 be small, and typically the spin density of g=2.001 due to a dangling bond of silicon be lower than or equal to $1\times10^{18}$ spins/cm$^3$. The spin density is measured by electron spin resonance (ESR) spectroscopy.

The insulating film 1122, which has a function of supplying part of the oxygen to the oxide semiconductor films 1130*a* to 1130*c* by heating, is preferably an oxide. Examples of the oxide include aluminum oxide, magnesium oxide, silicon oxide, silicon oxynitride, silicon nitride oxide, gallium oxide, germanium oxide, yttrium oxide, zirconium oxide, lanthanum oxide, neodymium oxide, hafnium oxide, and tantalum oxide. The insulating film 1122 can be formed by a plasma-enhanced CVD method, a sputtering method, or the like.

Note that in this specification, oxynitride contains more oxygen than nitrogen, and nitride oxide contains more nitrogen than oxygen.

Note that in the transistor 412 illustrated in FIG. 8, the gate electrode 1134 overlaps with end portions of the oxide semiconductor film 1130*b* including a channel region that are not overlapped with the conductive films 1132 and 1133, i.e., end portions of the oxide semiconductor film 1130*b* that are in a region different from a region where the conductive films 1132 and 1133 are located. When the end portions of the oxide semiconductor film 1130*b* are exposed to plasma by etching for forming the end portions, a chlorine radical, a fluorine radical, or other radicals generated from an etching gas are easily bonded to a metal element contained in an oxide semiconductor. For this reason, in the end portion of the oxide semiconductor film, oxygen bonded to the metal element is easily eliminated, so that an oxygen vacancy is easily formed; thus, the oxide semiconductor film easily has n-type conductivity. However, an electric field applied to the end portions can be controlled by controlling the potential of the gate electrode 1134 because the end portions of the oxide semiconductor film 1130*b* that are not overlapped with the conductive films 1132 and 1133 are overlapped with the gate electrode 1134 in the transistor 412 illustrated in FIG. 8. Consequently, current that flows between the conductive films 1132 and 1133 through the end portions of the oxide semiconductor film 1130*b* can be controlled by the potential applied to the gate electrode 1134. This structure of the transistor 412 is referred to as a surrounded channel (s-channel) structure.

With the s-channel structure, specifically, when a potential at which the transistor 412 is turned off is supplied to the gate electrode 1134, the amount of off-state current that flows between the conductive films 1132 and 1133 through the end portions of the oxide semiconductor film 1130*b* can be reduced. For this reason, in the transistor 412, even when the distance between the conductive films 1132 and 1133 at the end portions of the oxide semiconductor film 1130*b* is reduced as a result of reducing the channel length to obtain high on-state current, the transistor 412 can have low off-state current. Consequently, with the short channel length, the transistor 412 can have high on-state current when in an on state and low off-state current when in an off state.

With the s-channel structure, specifically, when a potential at which the transistor 412 is turned on is supplied to the gate electrode 1134, the amount of current that flows between the conductive films 1132 and 1133 through the end portions of the oxide semiconductor film 1130*b* can be increased. The current contributes to an increase in the field-effect mobility and on-state current of the transistor 412. When the end portions of the oxide semiconductor film 1130*b* are overlapped with the gate electrode 1134, carriers flow in a wide region of the oxide semiconductor film 1130*b* without being limited to a region in the vicinity of the interface between the oxide semiconductor film 1130*b* and the gate insulating film 1131, which results in an increase in carrier mobility of the transistor 412. As a result, the on-state current of the transistor 412 is increased, and the field-effect mobility is increased. Typically, the field-effect mobility is greater than or equal to 10 $cm^2/V \cdot s$ or greater than or equal to 20 $cm^2/V \cdot s$. Note that here, the field-effect mobility is not an approximate value of the mobility as the physical property of the oxide semiconductor film but is an index of current drive capability and the apparent field-effect mobility of a saturation region of the transistor.

An insulating film 1135 is provided over the transistor 412. An opening is formed to penetrate the insulating film 1135. A conductive film 1136 electrically connected to the conductive film 1132 is formed in the opening. The conductive film 1136 is electrically connected to a conductive film 1137 on the insulating film 1135. With this structure, the source or drain electrode of the transistor 412 can be extracted to the upper wiring. Note that one embodiment of the present invention is not limited to the structure in FIG. 8.

A semiconductor device in this specification and the like is not limited to the semiconductor device in FIG. 8 using a single crystal silicon substrate as the substrate 1100. The substrate is not limited to a particular type, and a variety of substrates can be used in the transistor in this specification and the like. For example, a semiconductor substrate (e.g., a single crystal substrate or a silicon substrate), an SOI substrate, a glass substrate, a quartz substrate, a plastic substrate, a metal substrate, a stainless steel substrate, a substrate containing stainless steel foil, a tungsten substrate, a substrate containing tungsten foil, a flexible substrate, an attachment film, paper containing a fibrous material, and a base material film can be used. Examples of the glass substrate include a barium borosilicate glass substrate, an aluminoborosilicate glass substrate, and a soda lime glass substrate. Examples of the flexible substrate, the attachment film, and the base material film are as follows: plastic typified by polyethylene terephthalate (PET), polyethylene naphthalate (PEN), and polyether sulfone (PES); a synthetic resin such as acrylic; polypropylene; polyester; vinyl; polyvinyl fluoride; polyvinyl chloride; polyamide; polyimide; aramid; epoxy; an inorganic vapor deposition film; and paper. The use of semiconductor substrates, single crystal substrates, SOI substrates, and the like enables fabrication of small-sized transistors with a small variation in characteristics, size, shape, or the like and with high current capability. A circuit using the transistors can have lower power consumption and higher integration.

Alternatively, a flexible substrate may be used and the transistor may be formed thereon directly. A separation layer may be provided between the substrate and the transistor. The separation layer can be used when part or the whole of a semiconductor device formed over the separation layer is separated from the substrate and transferred to another substrate. In such a case, the transistor can be transferred to a substrate having low heat resistance or a flexible substrate as well. For the above separation layer, a stack including inorganic films, which are a tungsten film and a silicon oxide film, or an organic resin film of polyimide or the like formed over a substrate can be used, for example.

In other words, a transistor may be formed on one substrate and then transferred to another substrate. Examples of a substrate to which a transistor is transferred include, in addition to the above substrate over which the transistor can be formed, a paper substrate, a cellophane substrate, an aramid film substrate, a polyimide film substrate, a stone substrate, a wood substrate, a cloth substrate (including a natural fiber (e.g., silk, cotton, or hemp), a synthetic fiber (e.g., nylon, polyurethane, or polyester), a regenerated fiber (e.g., acetate, cupra, rayon, or regenerated polyester), and the like), a leather substrate, and a rubber substrate. When such a substrate is used, a transistor with excellent properties or a transistor with low power consumption can be formed, a device with high durability, high heat resistance can be provided, or reduction in weight or thickness can be achieved.

This embodiment can be implemented in combination with any of the other embodiments as appropriate.

(Embodiment 6)

Embodiment 6 describes electronic devices including the display correction circuit or the display correction system described in the above embodiments with reference to FIGS. 9A to 9D.

Described is electronic devices, such as a computer, a portable information terminal (including a cellular phone, a portable game machine, and an audio reproducing device), a television (also referred to as a TV or a television receiver), which includes the display correction circuit or display correction system.

Figure 9A:
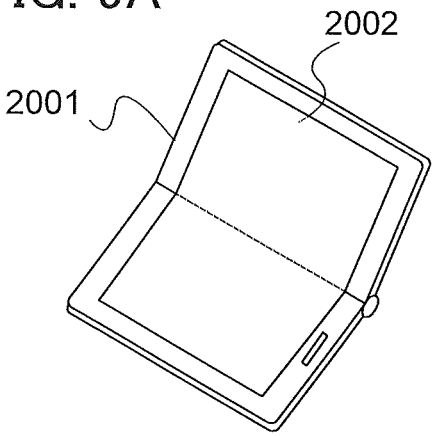
FIGS. 9A to 9D each illustrate an electronic device employing one embodiment of the present invention.

FIG. 9A illustrates a portable information terminal including a housing 2001 and a display portion 2002. The housing 2001 is foldable. The display portion 2002 can be folded in half using a flexible display device, specifically a flexible organic EL panel is used. The portable information terminal can be folded away for storage with a half of the size in displaying, which makes it easier to take anywhere. The display correction circuit of one embodiment of the present invention is beside the display portion 2002. A controller, an image processing circuit, and a CPU are inside the housing 2001.

The portable information terminal in FIG. 9A can have a function of displaying a variety of information (e.g., a still image, a moving image, and a text image) on the display portion, a function of displaying a calendar, a date, the time, and the like on the display portion, a function of operating or editing the information displayed on the display portion, a function of controlling processing by various kinds of software (programs), and the like. Furthermore, an external connection terminal (an earphone terminal, a USB terminal, or the like), a recording medium insertion portion, and the like may be provided on the back surface or the side surface of the housing. In addition, the portable information terminal illustrated in FIG. 9A may transmit and receive data wirelessly. Through wireless communication, desired book data or the like can be purchased and downloaded from an e-book server.

Figure 9C:
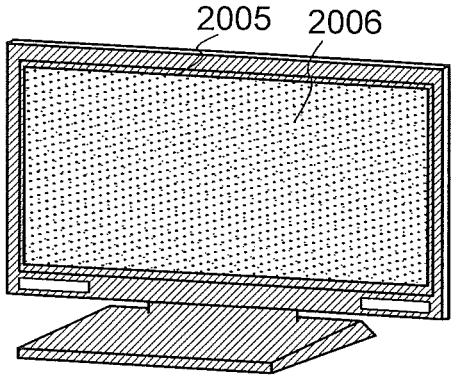
Figure 9B:
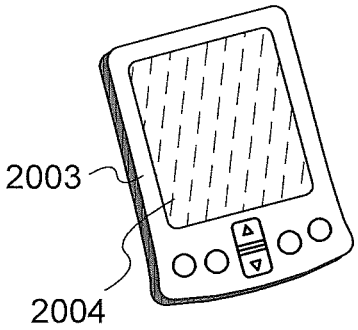

FIG. 9B illustrates a smartphone including a housing 2003 and a display portion 2004. A smartphone has many functions other than phone call, such as a game, a portable music player, navigation system, and a portable television and thus needs a high-definition display screen. A high-definition display is achieved with the display correction circuit or the display correction system of one embodiment of the present invention.

FIG. 9C illustrates a monitor of a personal computer including a housing 2005 and a display portion 2006. In recent years, resolution of personal computers have been increased and 4K (3840×2160) personal computers have been released. A high-resolution display with good display characteristics is achieved when the display correction circuit or the display correction system of one embodiment of the present invention is used for the display portion 2006.

Figure 9D:
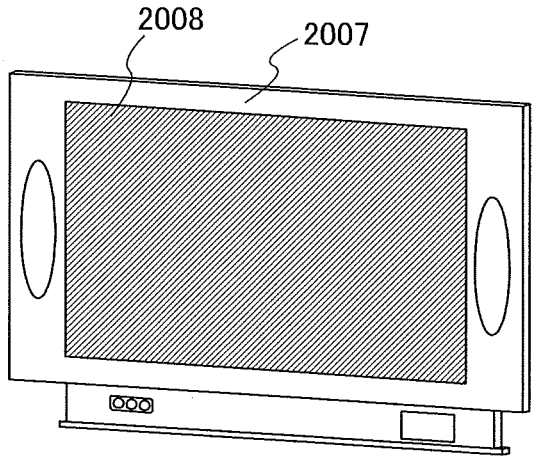

FIG. 9D is a television device, which includes a housing 2007 and a display portion 2008. The television device can be operated by a switch of the housing 2007 or a remote controller. The use of the display correction circuit or the display correction system of one embodiment of the present invention can provide a favorable display.

Since the electronic devices shown in Embodiment 6 each include an electronic component provided with the display correction circuit or the display correction system described in the above embodiments, they can consume less power and operate at high speed.

This application is based on Japanese Patent Application serial no. 2014-097986 filed with Japan Patent Office on May 9, 2014, the entire contents of which are hereby incorporated by reference.

What is claimed is:

1. A display device comprising:

a display correction circuit comprising:

a capacitor configured to be input a driving current of a pixel;

a transistor configured to reset a potential of the capacitor;

a first terminal electrically connected to one electrode of the capacitor and one of a source and a drain of the transistor;

a buffer circuit electrically connected to the capacitor;

an AD converter configured to convert an analog output of the buffer circuit into a digital output; and an output circuit configured to sequentially output data output from the AD converter, the output circuit comprising a shift register; and a display region including the pixel, the pixel electrically connected to a second terminal, wherein a channel formation region of the transistor includes an oxide semiconductor including indium, wherein the display correction circuit is provided outside the display region, and wherein the one electrode of the capacitor and the one of the source and the drain of the transistor are electrically connected to the pixel through the first terminal and the second terminal.

2. The display device according to claim 1, wherein the driving current of the pixel is 100 nA or smaller.

3. The display device according to claim 1, wherein the pixel includes an organic EL element.

4. The display device according to claim 1, wherein the display region is formed over a substrate, and wherein the display correction circuit is mounted on the substrate.

5. The display device according to claim 1, wherein the display region and the display correction circuit are formed over a substrate.

6. A display device comprising:

a display correction circuit comprising:

a capacitor configured to be input a driving current of a pixel;

a transistor configured to reset a potential of the capacitor;

a first terminal electrically connected to one electrode of the capacitor and one of a source and a drain of the transistor;

a buffer circuit electrically connected to the capacitor;

an AD converter configured to convert an analog output of the buffer circuit into a digital output; and an output circuit configured to sequentially output data output from the AD converter, the output circuit comprising a shift register;

an image processing circuit configured to form correction data from an output result of the output circuit and correct a video signal using the correction data;

a memory configured to store the correction data; and a display region including the pixel, the pixel electrically connected to a second terminal, wherein a channel formation region of the transistor includes an oxide semiconductor including indium, wherein the display correction circuit is provided outside the display region, and wherein the one electrode of the capacitor and the one of the source and the drain of the transistor are electrically connected to the pixel through the first terminal and the second terminal.

7. The display device according to claim 6, wherein the driving current of the pixel is 100 nA or smaller.

8. The display device according to claim 6, wherein the pixel includes an organic EL element.

9. The display device according to claim 6, wherein the display region is formed over a substrate, and wherein the display correction circuit is mounted on the substrate.

10. The display device according to claim 6, wherein the display region and the display correction circuit are formed over a substrate.

* * * * *